US012030126B2

(12) United States Patent
Thuo et al.

(10) Patent No.: US 12,030,126 B2
(45) Date of Patent: Jul. 9, 2024

(54) UNDERCOOLED LIQUID METALLIC DROPLETS HAVING A PROTECTIVE SHELL

(71) Applicant: THE INDIUM CORPORATION OF AMERICA, Clinton, NY (US)

(72) Inventors: Martin Thuo, Ames, IA (US); Ian Tevis, Ames, IA (US)

(73) Assignee: THE INDIUM CORPORATION OF AMERICA, Clinton, NY (US)

( * ) Notice: Subject to any disclaimer, the term of this patent is extended or adjusted under 35 U.S.C. 154(b) by 0 days.

(21) Appl. No.: 17/383,150

(22) Filed: Jul. 22, 2021

(65) Prior Publication Data

US 2022/0023940 A1 Jan. 27, 2022

Related U.S. Application Data

(60) Provisional application No. 63/056,448, filed on Jul. 24, 2020.

(51) Int. Cl.
*B22F 9/06* (2006.01)

(52) U.S. Cl.
CPC ..... *B22F 9/06* (2013.01); *B22F 2201/01* (2013.01); *B22F 2201/03* (2013.01)

(58) Field of Classification Search
CPC ..... B22F 1/0007; B22F 9/06; B22F 1/065; B23K 35/0244; B23K 35/264
See application file for complete search history.

(56) References Cited

U.S. PATENT DOCUMENTS 4,042,374 A 8/1977 Rasmussen et al.
11,174,701 B2 11/2021 Pearl, Jr. et al.
2004/0096688 A1* 5/2004 Tadauchi ..... B23K 35/262 428/570
2016/0317992 A1 11/2016 Thuo et al.
2017/0014958 A1* 1/2017 Thou ..... B23K 35/3013
2020/0146142 A1 5/2020 Thrasher et al.

FOREIGN PATENT DOCUMENTS

CN 109482859 3/2019
EP 3142124 3/2017
JP 2018-529018 A 10/2018

OTHER PUBLICATIONS

Cutinho et al. ("Autonomous thermal-oxidative composition inversion and texture tuning of liquid metal surfaces." ACS nano 12.5 (2018): 4744-4753.) (Year: 2018).*
Application No. PCT/US2021/043042, International Search Report and Written Opinion, dated Nov. 4, 2021, 11 pages.
Office Action dated Mar. 8, 2024 for Japanese Application No. 2023-505413.

* cited by examiner

*Primary Examiner* — Samir Shah
*Assistant Examiner* — Ricardo D Morales
(74) *Attorney, Agent, or Firm* — Sheppard, Mullin, Richter & Hampton LLP

(57) ABSTRACT

A droplet comprises a core including an alloy comprising a majority of a first metallic element and a minority of a second element, wherein the core is in a liquid state below a solidus temperature of the alloy. A shell is arranged to enclose the core and includes an exterior surface comprising a majority of the second element and a minority of the first metallic element, wherein the shell is in a solid state below the solidus temperature of the alloy. The alloy can comprise a solder material that can be used to form solder connections below a solidus temperature of the alloy.

20 Claims, 22 Drawing Sheets

SUPPORTING INFORMATION

| ACID | Tf (K) | Tm (K) | ΔT (K) | ΔT/Tm | YIELD (%) |
|---|---|---|---|---|---|
| TRICHLOROACETIC | 263.92 | 411.29 | 147.37 | 0.36 | 89.13 |
| TRIBROMOACETIC | 337.78 | 411.3 | 38.58 | 0.18 | 48.78 |
| CHLOROACETIC | 356.48 | 411.59 | 55.11 | 0.13 | 52.53 |
| PHOSPHOTUNGSTIC | 273.27 | 415.38 | 142.11 | 0.34 | 64.50 |

FIG. 11A

| THE STABILIZATION OF THE UNDERCOOLING IS DUE TO NATURE OF THE OXIDE NOT JUST COMPOSITION Sn PARTICLES FORMED IN POLYPHENOL ETHER BY REACTION WITH | SUPERCOOLING EXOTHERM MAXIMUM °C | RANGE °C | MELTING POINT OF TIN | FREEZING POINT | ΔT | Tm (K) | ΔT/Tm | |
|---|---|---|---|---|---|---|---|---|
| SULFUR | 50 | 15 | 232 | 182 | 50 | 505.15 | 0.10 | A |
| SULFURIC ACID | 85 | 10 | 232 | 147 | 85 | 505.15 | 0.17 | |
| AIR | 105 | 16 | 232 | 127 | 105 | 505.15 | 0.21 | |
| CUMENE HYDROPEROXIDE | 108 | 20 | 232 | 124 | 108 | 505.15 | 0.21 | |
| COPPER ISOPHTHALATE | 121 | 27 | 232 | 111 | 121 | 505.15 | 0.24 | B |
| SILVER ISOPHTHALATE | 117 | 26 | 232 | 115 | 117 | 505.15 | 0.23 | |
| DI-T-BUTYL PEROXIDE IN THE PRESENCE OF ISOPHTHALIC ACID | 117 | 17 | 232 | 115 | 117 | 505.15 | 0.23 | C |
| BENZOYL PEROXIDE IN THE PRESENCE OF ISOPHTHALIC ACID | 116 | 18 | 232 | 116 | 116 | 505.15 | 0.23 | |

A = POOR OXIDE SHELL FORMATION, ELEMENTAL AND ANIONIC
B = ANIONIC COATING ADDUCT FROM SALTS
C = ORGANIC COATING BUT FROM THE CARBOXYLIC ACID

FIG. 11B

| METAL | $T_f$(K) | $T_m$(K) | ΔT(K) | $\Delta T/T_m$ | YIELD (%) |
|---|---|---|---|---|---|
| BiSn | 263.92 | 411.29 | 147.37 | 0.36 | 89.13 |
| BiSnGe | 264.17 | 411.29 | 147.12 | 0.36 | 87.40 |
| BiSnSb | 285.84 | 414.64 | 128.8 | 0.31 | 63.25 |
| BiSnTe | 265.31 | 411.24 | 145.93 | 0.35 | 80.56 |
| BiSnGa | 277.21 | 411 | 133.79 | 0.33 | 98.33 |
| BiSnAu | 277.61 | 411.56 | 133.95 | 0.33 | 65.11 |
| BiSnIn | 224.03 | 336.89 | 112.86 | 0.34 | 100 |
| BiSnPb | 255.45 | 366.59 | 111.14 | 0.30 | 100 |
| BiSnPbCd | 270.57 | 398.74 | 128.17 | 0.32 | 94.92 |

FIG. 13

| ELEMENT, ATOMIC NUMBER | MELTING POINT (°C) | REDUCTION POTENTIAL (V) |
|---|---|---|
| BORON (B), 5 | 2076 | -2.04 V |
| ALUMINUM (Al), 13 | 660 | -1.67 V |
| SILICON (Si), 14 | 1414 | -1.37 V |
| PHOSPHORUS (P), 15 | 44 | -21.9 V |
| IRON (Fe), 26 | 1538 | -0.44 V |
| NICKEL (Ni), 28 | 1453 | -0.257 V |
| COPPER (Cu), 29 | 1085 | 0.52 V |
| ZINC (Zn), 30 | 419 | -0.7618 |
| GALLIUM (Ga), 31 | 30 | -0.56 V |
| GERMANIUM (Ge), 32 | 938 | |
| ZIRCONIUM (Zr), 40 | 1855 | |
| NIOBIUM (Nb), 41 | 2477 | |
| SILVER (Ag), 47 | 962 | 0.7996 V |
| CADMIUM (Cd), 48 | 321 | -0.403 V |
| INDIUM (In), 49 | 156.59 | |
| TIN (Sn), 50 | 232 | -0.14 V |
| ANTIMONY (Sb), 51 | 631 | - 0.510 V |
| TEELLURIUM (Te), 52 | 449 | |
| HALFNIUM (Hf), 72 | 2233 | |
| TANTALLUM (Ta), 73 | 3017 | |
| PLATINUM (Pt), 78 | 1768 | 1.2 V |
| GOLD (Au), 79 | 1064 | 1.83 V |
| LEAD (Pb), 82 | 327 | -0.126 V |
| BISMUTH (Bi), 83 | 271 | 0.317 V |
| | | |
| LANTHANUM (La), 57 | 920 | -2.38 V |
| SAMARIUM (Sm), 62 | 1072 | |
| EUROPIUM (Eu), 63 | 826 | |
| HOLMIUM (Ho), 67 | 1461 | |
| ERBIUM (Er), 68 | 1529 | |
| THULIUM (Tm), 69 | 1545 | 0.742 V |

FIG. 16

| METAL | BEFORE REFLOW | | | | |
|---|---|---|---|---|---|
| | $T_f$(K) | $T_m$(K) | ΔT | ΔT/$T_m$ | YIELD (%) |
| BiSn | 268.63 | 411.13 | 142.5 | 0.35 | 85.8 |
| BiSnIn | 224.03 | 336.89 | 112.86 | 0.34 | 100 |
| BiSnPb | 271.99 | 366.38 | 94.39 | 0.26 | 72.0 |
| BiSnPbCd | 270.60 | 343.30 | 72.70 | 0.21 | 87.0 |
| BiSnPbCdIn | 276.70 | 320.25 | 43.55 | 0.14 | 95.0 |
| BiSn+Ga | 276.06 | 383.00 | 106.94 | 0.28 | 41.0 |
| BiSn+Ge | 274.90 | 411.16 | 136.26 | 0.33 | 84.0 |
| BiSn+15% Ge | 302.1 | 410.07 | 107.97 | 0.26 | 52.0 |
| BiSn+Sb | 286.21 | 416.07 | 129.86 | 0.31 | 0.0 |
| BiSn+Te | 265.08 | 412.32 | 147.24 | 0.36 | 76.0 |
| BiSn+Ho | 302.96 | 411.14 | 108.18 | 0.26 | 80.7 |
| BiSn+Au | 284.14 | 411.49 | 127.35 | 0.31 | 0.0 |
| BiSn+Au+Ag | 356.95 | 411.95 | 55.00 | 0.13 | 0.0 |
| SAC305 | 377.00 | 493.00 | 116.00 | 0.24 | 95.2 |
| SAC305+Ga | 373.23 | 434.00 | 60.77 | 0.14 | 93.6 |
| SAC305+In | 407.28 | 493.00 | 85.97 | 0.16 | 53.3 |
| SAC305+Bi | 373.04 | 475.57 | 102.53 | 0.22 | 100 |
| SAC305+Ssb | 379.97 | 495.93 | 97.96 | 0.20 | 100 |
| SAC305+Sb+Ga | 378.52 | 451.00 | 72.48 | 0.16 | 34.4 |

FIG. 17

UNDERCOOLED LIQUID METALLIC DROPLETS HAVING A PROTECTIVE SHELL

CROSS-REFERENCE TO RELATED APPLICATIONS

This application claims priority to U.S. Provisional Patent Application No. 63/056,448, filed on Jul. 24, 2020 and entitled "UNDERCOOLED LIQUID METALLIC DROPLETS HAVING A PROTECTIVE SHELL," which is hereby incorporated by reference in its entirety.

BACKGROUND

Currently there are a wide variety of electronic devices that include low-temperature materials which are not suitable for forming soldered connections due to the high processing temperature required for soldering. New low-temperature soldering materials and processes are needed for electronic devices having low-temperature materials.

SUMMARY

Some embodiments of the present disclosure relate to undercooled liquid metal droplets surrounded by a protective shell that maintains the core in a liquid state below a solidus temperature of the core material. The protective shell can be relatively free from nucleation sites and can impose a thermodynamic barrier that prevents the core from transitioning to a solid below the solidus temperature of the core. The shell can include one or more layers that are arranged according to the reduction potential of each element. The shell can be coated in a fluid that protects the exterior of the shell from oxidation and degradation. In some embodiments the liquid metal droplets can be used for soldering materials at temperatures below the solidus temperature of the droplets.

In some embodiments a droplet comprises a core comprising a majority of a first metallic element and a minority of a second element, wherein the core is in a liquid state below a solidus temperature of the first metallic element. A shell is arranged to enclose the core and includes an exterior surface comprising a majority of the second element and a minority of the first metallic element, the shell is in a solid state below the solidus temperature of the first metallic element. In various embodiments the second element is a metal. In some embodiments the second element is a metalloid. In various embodiments the shell includes a concentration gradient that transitions from a first concentration of the second element at an interior surface of the shell to a second concentration at the exterior surface, wherein the first concentration is less than the second concentration.

In some embodiments the droplet further comprises a fluid disposed on the exterior surface. In various embodiments the exterior of the shell comprises a third element having a concentration that is less than a concentration of the first metallic element and of the second element. In some embodiments the shell includes a concentration gradient of at least the first metallic element and the second element that prevents the core from transitioning to a solid state. In various embodiments the first metallic element and the second element at the exterior surface are oxides of the first metallic element and oxides of the second element. In some embodiments the first metallic element has a lower $E^o$ than the second element. In various embodiments the second element has a higher $E^o$ than the first metallic element.

In some embodiments a droplet comprises a core comprising at least one metallic element in a liquid phase and a shell in a solid phase and arranged to fully enclose the core. The shell comprises a concentration gradient of the at least one metallic element that changes through a thickness of the shell, wherein the shell prevents the metallic element transitioning to a solid phase at a temperature below a solidus temperature of the of the at least one metallic element. In various embodiments the shell has at least two layered regions, wherein each of the at least two layered regions are defined by a unique element having a predominant concentration within each layered region.

In some embodiments the at least one metallic element is a first metallic element and the core includes a second metallic element having a lower concentration than the first metallic element. In various embodiments the first metallic element forms a predominant percentage of an interior region of the shell and the second metallic element forms a predominant percentage of an exterior region of the shell. In some embodiments a concentration of the first metallic element declines from the interior region of the shell to the exterior region of the shell, and a concentration of the second metallic element increases from the interior region of the shell to the exterior region.

In some embodiments changes in concentrations of the first and second metallic elements generate a thermodynamic shift in an activation energy for the core to transition from a liquid phase to a solid phase. In various embodiments the interior region of the shell includes oxides and suboxides of the first metallic element, and the exterior region of the shell includes oxides and suboxides of the second metallic element. In some embodiments the second metallic element has a lower $E^o$ than the first metallic element.

In some embodiments a droplet comprises an undercooled liquid core comprising a first element, a second element and a third element, wherein the first element is of higher concentration than the second and the third elements. A solid shell encompasses the liquid core and comprises a concentration gradient of the first, the second and the third elements. In various embodiments the first, the second and the third elements are arranged in layers to form the shell.

In some embodiments a method of forming a droplet comprises forming a liquid core of the droplet from an alloy including a first element, a second element and a third element and forming a solid shell around the liquid core. The solid shell comprises an innermost layer having a predominant concentration of one of the first, the second or the third elements and an outermost layer having a predominant concentration of a different one of the first, the second or the third elements. The method further comprise cooling the liquid core and the solid shell below a solidus temperature of the alloy while maintaining the core in a liquid state.

In some embodiments the solid shell includes three layers, wherein the innermost layer has a predominant concentration of the first element, an intermediate layer has a predominant concentration of the second element and the outermost layer has a predominant concentration of the third element. In various embodiments the shell is formed in an oxidizing environment. In some embodiments the oxidizing environment is controlled by changing a partial pressure of oxygen in the oxidizing environment. In various embodiments the innermost layer has a greater $E^o$ than the intermediate layer and wherein the intermediate layer has a greater $E^o$ than the outermost layer. In some embodiments a thickness of one or more of the three layers of the solid shell is determined by a time of exposure to the oxidizing environment In some embodiments the shell is formed in a reducing environment. In various embodiments the innermost layer has a lower $E^o$ than the intermediate layer and the intermediate layer has a lower $E^o$ than the outermost layer. In some embodiments a thickness of one or more of the three layers of the solid shell is determined by a time of exposure to the reducing environment. In various embodiments the method further comprises exposing the solid shell to one or more chelating agents to remove at least a portion of the outermost layer. In various embodiments the one or more chelating agents can be used to polish an exterior surface of the shell which can improve activation, droplet packing and flow of the droplets which are all characteristics that can improve performance of the droplets in a solder paste material (e.g., a combination of droplets and flux). In some embodiments the one or more chelating agents comprises at least one of a carboxylate, an amide, an alkoxide, an amine, a thiol or a phosphate. In various embodiments the method further comprises an etching process that polishes an inner layer of the solid shell.

Numerous benefits are achieved by way of the present invention over conventional techniques. For example, embodiments of the present invention provide the ability to solder materials at temperatures below a solidus temperature of the core elements.

BRIEF DESCRIPTION OF THE DRAWINGS

FIG. 11A shows a table of organic ligands of varying properties that were investigated, according to embodiments of the disclosure;

FIG. 11B shows a table of variations of the nature of the oxide shell, according to embodiments of the disclosure;

FIG. 13 shows a table of various alloys that were evaluated and the results thereof, according to embodiments of the disclosure;

FIG. 16 shows a table including constants of elements used in some embodiments, according to embodiments of the disclosure;

FIG. 17 shows a table tabulating the undercooling level and yield, before and after reflow, for various alloys according to some embodiments of the disclosure.

DETAILED DESCRIPTION

Techniques disclosed herein relate generally to undercooled liquid metallic droplets that are enclosed by a solid shell. More specifically, techniques disclosed herein relate to droplets of metal that are in a stable liquid state below their solidus temperature and that are encased in a shell that has one or more solid metallic and/or organic layers. In some embodiments, the shell can be designed to frustrate (e.g., prevent) the droplet's phase transition from liquid to solid, as explained in more detail below. Various inventive embodiments are described herein, including methods, processes, systems, configurations, and the like.

For example, in some embodiments a droplet is formed that is enclosed by a shell having two or more layers where each layer includes a concentration gradient and is defined by a predominant element. In another example a droplet is formed that is enclosed by a shell having an exterior composition that is predominantly a different element than the predominant element of the core. In some embodiments the droplet may be formed in an oxidizing atmosphere to promote the formation of a particular exterior layer or arrangement of layers while in other embodiments the droplet may be formed in a reducing atmosphere to promote the formation of a different particular exterior layer or arrangement of layers.

In order to better appreciate the features and aspects of undercooled liquid metallic droplets that are enclosed by a solid metallic shell according to the present disclosure, further context for the disclosure is provided in the following section by discussing several particular configurations of undercooled metallic droplets according to embodiments of the present disclosure. These embodiments are for example only and other embodiments can have other configurations using different elements, fluid materials, gasses, layer organizations, etc.

Figure 1:
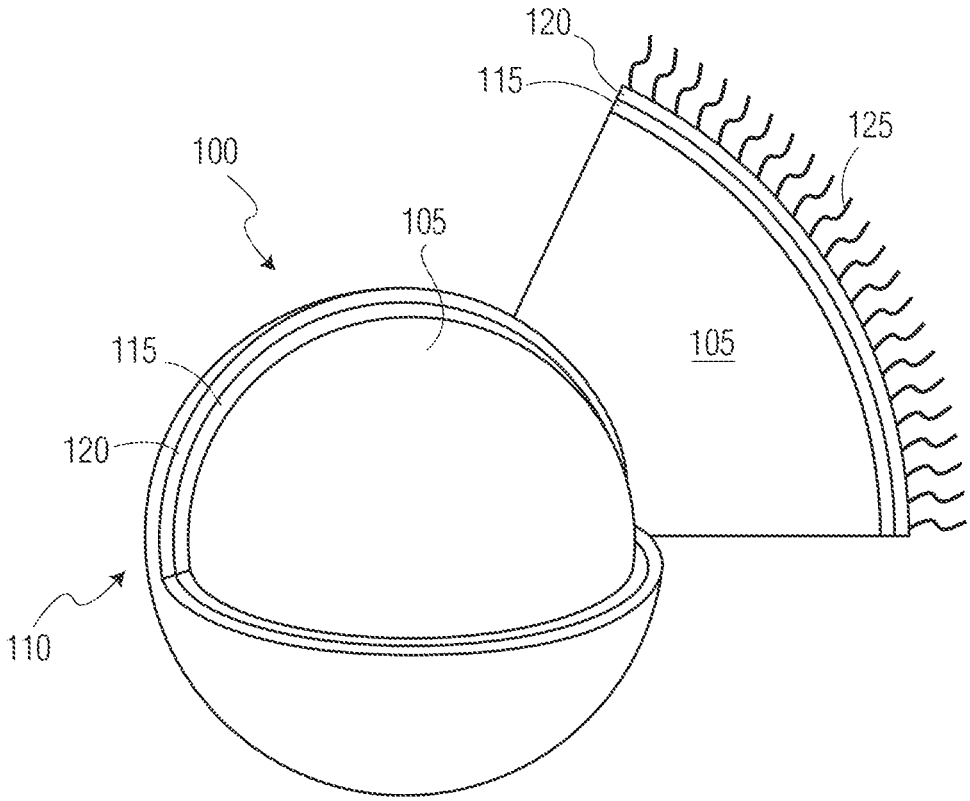
FIG. 1 depicts a simplified partial cross-sectional view of a droplet having an undercooled liquid metallic core enclosed by a solid metallic shell, according to embodiments of the disclosure.

FIG. 1 depicts a simplified partial cross-sectional view of a droplet 100 having an undercooled liquid metallic core 105 enclosed by a solid metallic shell 110, according to embodiments of the disclosure. In some embodiments shell 110 can prevent undercooled liquid metallic core 105 from transitioning to a solid when droplet 100 is exposed to temperatures below the solidus temperature of the liquid metallic core by providing an interior surface free from nucleation sites and/or by creating a "thermodynamic tension" that increases an energy threshold for liquid to solid phase transformation to occur, as explained in more detail below. As depicted in FIG. 1, shell 110 includes two layers 115, 120 that can each have a different composition, as described in more detail below. In some embodiments shell 110 can be made from one, two, three or more layers where each layer can be defined by a predominant concentration of a different element. In further embodiments, shell 110 can be terminated with a ligand 125 or other liquid, as described in more detail below.

More specifically as defined herein, a layer (e.g., 115, 125) is a region of a shell 110 that has a predominant concentration of a particular element. The approximate boundaries (e.g., innermost starting point and outermost ending point) of each layer are defined at the locations where that particular element is no longer predominant, and another element has a predominant concentration. Thus, each layer can also be called an enrichment region where each enrichment region can be defined by the predominance of a particular element, and wherein each enrichment region can have concentration gradients of two or more elements. In some embodiments the concentration gradients can be engineered to generate thermodynamic tension that frustrates phase transformation of the core, as described in more detail below.

In some embodiments that have multiple layers, each layer can be arranged according to the reduction potential $E^o$ of the predominant element within that layer, relative to the reduction potential of the predominant element in the other layers. More specifically, in some embodiments, the element having the lowest $E^o$ (e.g., largest propensity for forming an oxide within an oxidizing environment) can form the outermost layer of the shell and the element having the highest $E^o$ (e.g., lowest propensity for forming an oxide) can form the innermost layer of the shell. Conversely, when formed within reducing conditions, the inverse shell ordering can be formed. In further embodiments the arrangement of each layer may be dependent upon other factors, such as the propensity of each element to react with a gas or a fluid in which the droplet is formed. In some embodiments shell 110 can be at least partially terminated in a fluid which can be a ligand or other composition that improves the stability of the shell, as described in more detail below.

Two Layer Shell in Oxidizing Environment

Figure 2A:
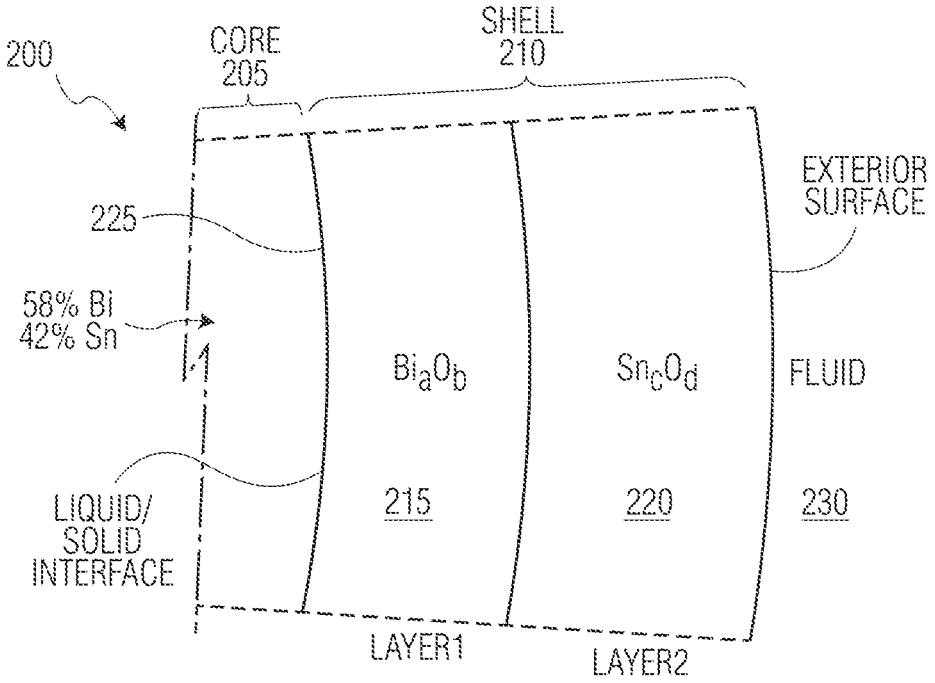
FIG. 2A illustrates a partial cross-sectional view of one example of a droplet having a two layer shell formed in an oxidizing environment, according to embodiments of the disclosure.

FIG. 2A illustrates a partial cross-sectional view of one example of a droplet having a two layer shell formed in an oxidizing environment, according to embodiments of the disclosure. As shown in FIG. 2A, liquid metallic core 205 of droplet 200 is predominantly elemental bismuth (Bi) with residual elemental tin (Sn). In the embodiment depicted in FIG. 2A core 205 includes 58 weight percent Bi and 42 weight percent Sn, however in other embodiments these elements can have any other suitable ratio. For example, in one embodiment core 205 includes 95 weight percent Bi and 5 weight percent Sn. In some embodiments liquid metallic core 205 is a single metallic element while in other embodiments it can be an alloy of a plurality of metallic elements or a combination of metallic, semi-metallic, metalloid and/or non-metallic elements, as described in further detail below. As further shown in FIG. 2A, core 205 includes a shell 210 having two layers where layer 1 (215) is an innermost layer and layer 2 (220) is an outermost layer. In the example shown in FIG. 2A, layer 1 (225) is predominately composed of bismuth oxide ($Bi_aO_b$ where a and b are any rational number) and layer 2 (220) is predominately composed of tin oxide ($Sn_cO_d$ where c and d are any rational number). In some embodiments each layer 215, 220 can have a concentration gradient of multiple metal oxides and can be defined by a predominant metal oxide (e.g., layer 1 (215) is predominantly bismuth oxide and layer 2 (220) is predominantly tin oxide, as described in more detail below.

An interior surface 225 of layer 1 (215) can have a relatively smooth surface free from nucleation sites, preventing nucleation and growth (i.e., phase transformation) of liquid metallic core 205 from transitioning to a solid at temperatures below the solidus temperature of the core material (e.g., below 138° C. for eutectic 58Bi42Sn). In some embodiments, the concentration gradients within shell 210 can create a thermodynamic tension that generates an increased energy barrier for liquid to solid phase transformation to occur, thereby increasing the stability of liquid metallic core 205 within the liquid state even further below its solidus temperature.

Figure 2B:
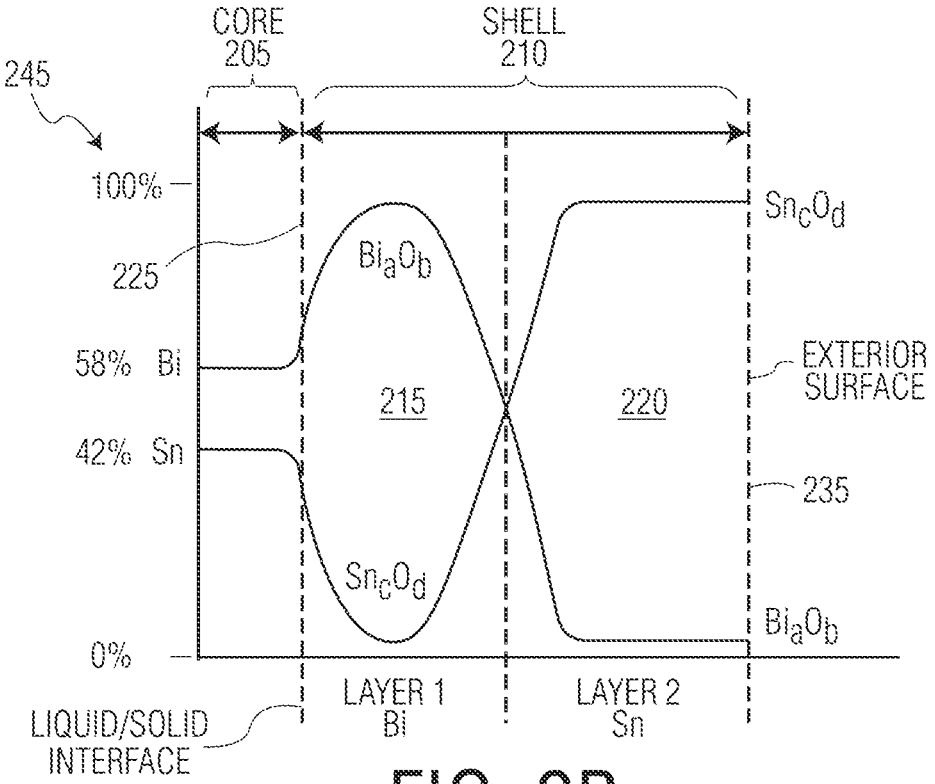
FIG. 2B illustrates an example concentration gradient graph of the relative concentrations of each element and oxides thereof (e.g., Sn and Bi) with regard to the cross-section of the droplet illustrated in FIG. 2A.

FIG. 2B illustrates an example concentration gradient graph of the relative concentrations of each element and oxides thereof (e.g., Sn and Bi) with regard to the cross-section of droplet 200 illustrated in FIG. 2A. These concentration gradients are for example only and other embodiments can have different elements and/or different concentration gradients. As shown in concentration graph 245 of FIG. 2B, starting at the left-hand portion of the graph within liquid core 205, the concentration of elemental Sn is relatively constant, near 42% and the concentration of elemental Bi is also relatively constant, near 58%.

Progressing into layer 1 (215) (i.e., towards the right in concentration graph 245 if FIG. 2B) first, the elemental Sn and Bi exist as oxides (e.g., $Bi_aO_b$ and $Sn_cO_d$) and the concentration of both elements (e.g., the oxides thereof) rapidly changes where bismuth oxide increases to approximately 90% while tin oxide decreases to approximately 10% in the middle portion of layer 1 (215). Towards the right side of layer 1 (215) the concentration of bismuth oxide reduces and the concentration of tin oxide increases such that at the interface between layer 1 (215) and layer 2 (220) the concentrations of tin oxide and bismuth oxide are equal. Thus within layer 1 the concentration of Bi is greater than Sn so layer 1 (215) can be identified as having a majority of Bi and a minority of Sn.

Now progressing into layer 2 (220) the composition of bismuth oxide continues to decline to approximately 10% while the concentration of tin oxide reaches a maximum at approximately 90%. Thus at an exterior surface 235 of shell 210, tin oxide has a greater concentration than bismuth oxide. In some embodiments, during the formation of shell 210 the environment may be a so-called "oxidizing environment" that includes one or more forms of oxygen that promote the formation of oxides (e.g., tin oxide and bismuth oxide). In some embodiments exterior surface 235 may be covered in a fluid 230 that stabilizes the exterior surface from oxidation and/or degradation, as described in more detail below.

The concentration gradients within shell 210 can create a thermodynamic tension that frustrates phase transformation of liquid core 205 to a solid. More specifically, the concentration gradient can generate a relatively large surface dipole creating a relatively large Laplace pressure jump condition which implies that the core is at a relatively high pressure to sustain such a large pressure jump condition. To solidify, a critical nucleant size is needed which would imply that there is diffusion away from this tension further increasing the free energy of the whole droplet 200. However, the free energy of droplet 200 should be decreasing for this to be a spontaneous process. This situation creates an increased barrier to solidification. As evidence of this condition, when high-melting point alloys are cooled they form a glass-like (e.g., amorphous) structure as opposed to a crystal structure which is what the metals prefer when under normal conditions. This change to an amorphous structure shows that the liquid to solid transition is likely occurring from a frustrated hyper- or hypoeutectic composition.

In the example shown in FIGS. 2A and 2B, liquid metallic core 205 is predominantly elemental Bi and shell 210 includes two layers where the exterior surface is predominantly a metal oxide (e.g., $Sn_cO_d$) that is different from the metallic core. More specifically, core 205 is predominately composed of Bi and the exterior surface of droplet is primarily composed of Sn.

In some embodiments core 205 may include a relatively minor percentage of other elements that may include, for example the element that dominates the exterior surface. As described herein, a minority percentage can be less than a comparative majority percentage. In further embodiments, the exterior surface may include a relatively small percentage (e.g., less than 50 percent, less than 10 percent, less than 1 percent) of other elements that may include, for example the element that dominates the core.

In some embodiments shell 210 may have one layer where the predominant element of the exterior surface of the shell is different from the predominant element of the core. For example, in one embodiment the predominant element of the liquid metallic core is tin and the predominant element of the shell is indium. That is, the core may be predominantly tin with a minority of indium and the exterior surface of the shell may be predominantly indium (e.g., indium oxide) with a minority of tin (e.g., tin oxide).

As used herein the term oxide (e.g., tin oxide) and the chemical representation (e.g., $Sn_cO_d$) represents all possible oxides of tin where c and d are rational numbers. Further, the particular oxides (e.g., rational numbers c and d) may change throughout a particular droplet where one form of tin oxide may exist within layer 1 (215) and another form may exist within layer 2 (220).

In some embodiments fluid 230 can present a physical barrier to physi- and chemi-sorption for shell 210. In one embodiment fluid is a ligand or other solution such as, but not limited to a: ammonia-based solution, sulfur-based solution, carboxylic acid, any organic acid, any inorganic acid, phosphotungstic acid, hexafluorophosphoric acid, trichloroacetic acid, tribromoacetic acid, chloroacetic acid, zwitterionic species (e.g., glutamic acid, serine etc.), dicarboxylic acids (e.g. glutaric acid, malonic acid, fumaric acid, oxalic, pimeric acid, etc), anhydrides, aldehydes or other functional groups that transform in situ to reactive species like dicarboxylates, acetals, ketals, hemiacetals etc. One of skill in the art having the benefit of this disclosure will appreciate that the above list of fluids is not exhaustive and that other organic and non-organic fluids can be used and are within the scope of this disclosure. In further embodiments after formation the exterior surface of shell 210 may be in contact with a gas, such as, for example nitrogen to prevent oxidation and/or degradation of shell 210. In yet further embodiments the exterior surface of shell 210 can be terminated in a relatively inert metal such as, for example gold, silver, nickel or platinum. In one embodiment the exterior surface may be stable without a fluid, gas or termination.

In some embodiments during the formation of shell 210 the process may be performed in an oxidizing environment. In one embodiment one or more forms of oxygen (e.g., O, $O^2$, $O^3$, etc.) may be injected in a gas form in the solution in which droplet 200 is formed to promote rapid oxide formation and growth of shell 210. In some embodiments this change can be referred to as changing a partial pressure of oxygen. Further, the oxidizing environment may promote the order of formation of the shell and the order of the shell layers, that is the elements having the highest potential for oxide formation may dominate the shell and form an exterior surface of the shell. A time of exposure to the oxidizing environment and/or the concentration of oxygen can change a thickness of one or more layers of the shell. Similarly, a change in the environment to a reducing atmosphere, where oxidation is prevented by removal of oxygen and other oxidizing gases may change an order of the layers of the shell. A reducing atmosphere may be formed via reducing gases such as hydrogen, carbon monoxide, and gases such as hydrogen sulfide that would be oxidized by any present oxygen.

3-Layer Shell in Oxidizing Environment

Figure 2C:
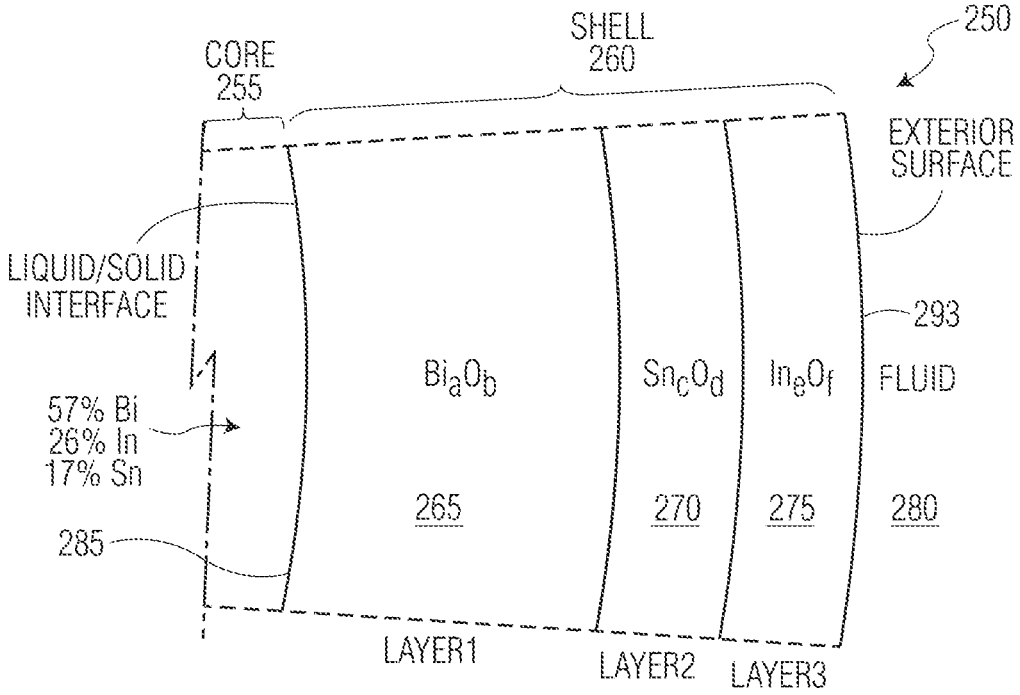
FIG. 2C illustrates a partial cross-sectional view of one example of a droplet having a three layer shell formed in an oxidizing environment, according to embodiments of the disclosure.

FIG. 2C illustrates a partial cross-sectional view of one example of a droplet having a three layer shell formed in an oxidizing environment, according to embodiments of the disclosure. As shown in FIG. 2C, liquid metallic core 255 of droplet 250 is predominantly elemental bismuth (Bi) with lesser amounts of elemental indium (In) and tin (Sn). In the embodiment depicted in FIG. 2C core 255 includes 57 weight percent Bi, 25 weight percent In and 17 weight percent Sn, however in other embodiments these elements can have any other suitable ratio. In some embodiments liquid metallic core 255 is a single metallic element while in other embodiments it can be an alloy of a plurality of metallic elements or a combination of metallic, semi-metallic, metalloid and/or non-metallic elements, as described in further detail below. As further shown in FIG. 2C, core 255 includes a shell 260 having three layers where layer 1 (265) is an innermost layer, layer 2 (270) is an intermediate layer and layer 3 (275) is an outermost layer. In the example shown in FIG. 2C, layer 1 (265) is predominately composed of bismuth oxide ($Bi_aO_b$ where a and b are any rational number), layer 2 (270) is predominately composed of tin oxide ($Sn_cO_d$ where c and d are any rational number) and layer 3 (275) is predominately composed of indium oxide ($In_eO_f$ where e and f are any rational number). In some embodiments each layer 265, 270, 275 can have a concentration gradient of multiple metal oxides and can be defined by a predominant metal oxide (e.g., layer 1 (265) is predominantly bismuth oxide, layer 2 (270) is predominantly tin oxide and layer 3 (275) is predominantly indium oxide, as described in more detail below.

An interior surface 285 of layer 1 (265) can have a relatively smooth surface free from nucleation sites, preventing nucleation and growth (i.e., phase transformation) of liquid metallic core 255 from transitioning to a solid at temperatures below the solidus temperature of the core material (e.g., below 62° C. for 57Bi26In17Sn). In some embodiments, the concentration gradients within shell 260 can create a thermodynamic tension that generates an increased energy barrier for liquid to solid phase transformation to occur, thereby increasing the stability of liquid metallic core 255 within the liquid state even further below its solidus temperature.

Figure 2D:
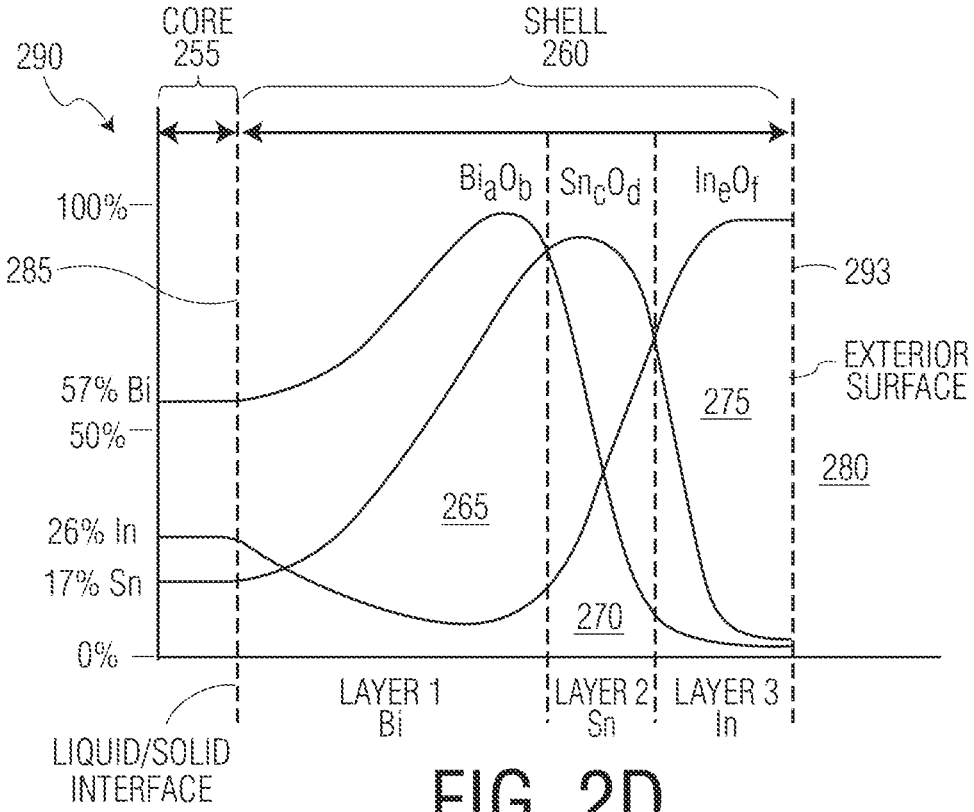
FIG. 2D illustrates an example concentration gradient graph of the relative concentrations of each element and oxides thereof (e.g., Bi, Sn and In) with regard to the cross-section of the droplet illustrated in FIG. 2C.

FIG. 2D illustrates an example concentration gradient graph of the relative concentrations of each element and oxides thereof (e.g., Bi, Sn and In) with regard to the cross-section of droplet 250 illustrated in FIG. 2C. These concentration gradients are for example only and other embodiments can have different elements and/or different concentration gradients. As shown in concentration graph 290 of FIG. 2D, starting at the left-hand portion of the graph within liquid core 285, the concentration of elemental Bi is relatively constant near 57%, the concentration of elemental In is relatively constant near 26% and the concentration of elemental Sn is also relatively constant near 17%.

Progressing into layer 1 (265) (i.e., towards the right in concentration graph 290 if FIG. 2D) first, the elemental Bi, Sn and In and exist as oxides (e.g., $Bi_aO_b$, $Sn_cO_d$ and $In_eO_f$) and the concentration of each element (e.g., the oxides thereof) changes where bismuth oxide increases to dominate, while tin oxide increases at a slower rate and indium oxide decreases. Towards the right side of layer 1 (265) the concentration of bismuth oxide is greater than that of tin oxide and indium oxide, thus layer 1 (265) can be identified as having a majority of Bi.

Now progressing into layer 2 (270) the composition of bismuth oxide declines while the concentration of tin oxide increases to dominate layer 2. Thus layer 2 (270) can be identified as having a majority of tin. Now progressing into layer 3 (275) the composition of tin oxide and bismuth oxide decline while indium continues to increase and dominate layer 3. Thus layer 3 (275) can be identified as having a majority of indium. Therefore, at an exterior surface 293 of shell 260, indium oxide has a greater concentration than bismuth oxide or tin oxide. In some embodiments, during the formation of shell 210 the environment may be a so-called "oxidizing environment" that includes one or more forms of oxygen that promote the formation of oxides (e.g., indium oxide, tin oxide and bismuth oxide). In some embodiments exterior surface 293 may be covered in a fluid 280 that stabilizes the exterior surface from oxidation and/or degradation, as described in more detail below.

The concentration gradients within shell 260 can create a thermodynamic tension that frustrates phase transformation of liquid core 255 to a solid. In the example shown in FIGS. 2C and 2D, liquid metallic core 255 is predominantly elemental Bi and shell 260 includes three layers where the exterior surface 293 is predominantly a metal oxide (e.g., $In_eO_f$) that is different from the metallic core. More specifically, core 255 is predominately composed of Bi and the exterior surface of droplet is primarily composed of In.

In some embodiments core 255 may include a relatively minor percentage of other elements that may include, for example the element that dominates the exterior surface. As described herein, a minority percentage can be less than a comparative majority percentage. In further embodiments, the exterior surface may include a relatively small percentage (e.g., less than 50 percent, less than 10 percent, less than 1 percent) of other elements that may include, for example the element that dominates the core.

In some embodiments shell 260 may have an outer layer where the predominant element of the exterior surface of the shell is different from the predominant element of the core. For example, in one embodiment the predominant element of the liquid metallic core is bismuth and the predominant element of the shell is indium. That is, in some embodiments the core may be predominantly bismuth with a minority of indium and the exterior surface of the shell may be predominantly indium (e.g., indium oxide) with a minority of bismuth (e.g., bismuth oxide).

In some embodiments fluid 230 can present a physical barrier to physi- and chemi-sorption for shell 260, as described in further detail above. In yet further embodiments the exterior surface 293 of shell 260 can be terminated in a relatively inert metal such as, for example gold, silver, nickel or platinum. In one embodiment the exterior surface may be stable without a fluid, gas or termination.

In some embodiments during the formation of shell 210 the process may be performed in an oxidizing environment. In one embodiment one or more forms of oxygen (e.g., O, $O^2$, $O^3$, etc.) may be injected in a gas form in the solution in which droplet 250 is formed to promote rapid oxide formation and growth of shell 260. Further, the oxidizing environment may promote the order of formation of the shell and the order of the shell layers, that is the elements having the highest potential for oxide formation may dominate the shell and form an exterior surface of the shell. Thus, a change in the environment to a reducing atmosphere, where oxidation is prevented by removal of oxygen and other oxidizing gases may change an order of the layers of the shell. A reducing atmosphere may be formed via reducing gases such as hydrogen, carbon monoxide, and gases such as hydrogen sulfide that would be oxidized by any present oxygen. Similarly, changing a time of exposure to and/or the concentration of the reducing gas in the environment may change a thickness of one or more layers of the shell. In further embodiments the environment may be dynamically changed between a reducing environment and an oxidizing environment during the growth of the shell to promote the formation of particular shell layers in a particular order.

The relative concentrations of Sn, In, Bi and the related oxides shown in FIGS. 2A-2D are for illustrative examples only. One of skill in the art having the benefit of this disclosure will appreciate that other embodiments may have different relative concentrations and/or different elements.

Manufacturing Process

Figure 3:
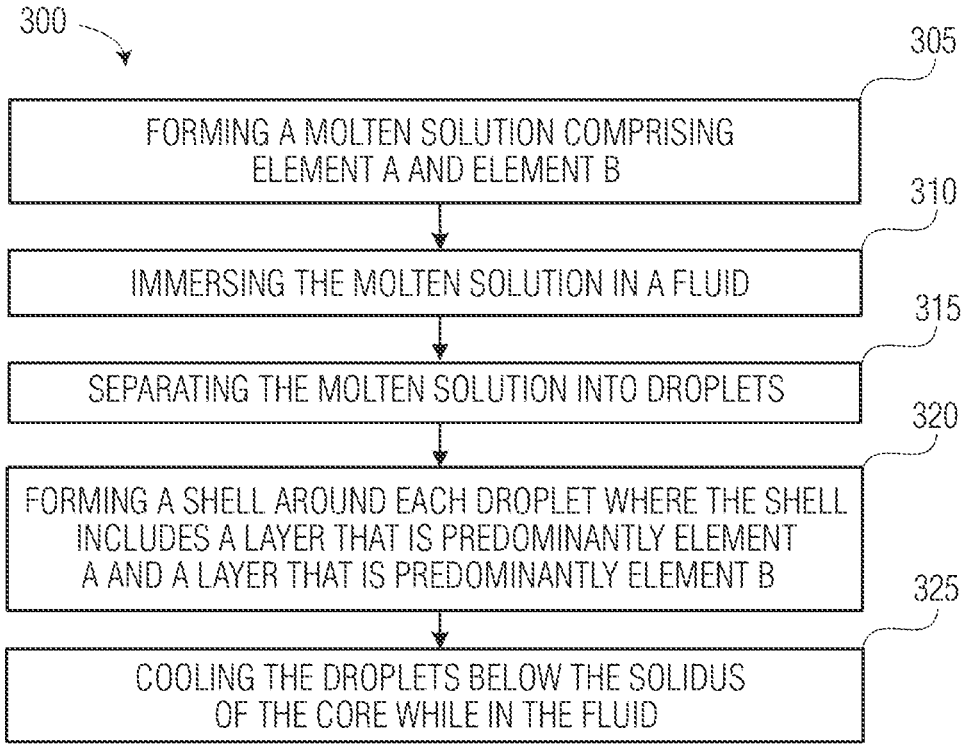
FIG. 3 illustrates steps associated with a method of forming undercooled droplets comprising a liquid metallic core enclosed by a solid shell that includes at least two layers, according embodiments of this disclosure.

FIG. 3 illustrates steps associated with a method 300 of forming undercooled droplets comprising a liquid metallic core enclosed by a solid shell that includes at least two layers, according embodiments of this disclosure. As described in FIG. 3, in step 305 a molten solution comprising a majority of element A and a minority of element B is prepared. In some embodiments the molten solution can be formed by heating up element A and adding element B. In other embodiments element A and element B may already be mixed but exist as a solid which can be simply heated up to form the molten solution.

In step 310 the molten solution from step 305 is immersed in a fluid. In some embodiment the fluid includes a conjugate acid-base pair where the acid component is configured to in situ polish the shell and the base is configured to stabilize the shell against physi-sorption and/or chemi-sorption. More specifically, in one embodiment the acid component smooths the interior surface of the shell to minimize nucleation sites that can cause the liquid metal core to solidify when cooled below the solidus temperature. In other embodiments other types of fluids can be used. In further embodiments one or more gasses can be added to the fluid such as, but not limited to, oxygen to promote the formation of oxides or a reducing gas to retard the formation of oxides. Example gasses are described in more detail herein and may be used to promote a particular order of formation of the one or more layers of the shell.

In step 315 the molten solution can be separated into droplets while immersed in the fluid and/or gas. In some embodiments the molten solution can be separated using a mechanical shearing apparatus such as a high speed blade that is immersed in the fluid. During shearing, each droplet is surrounded by the fluid and/or gas that can be introduced into the fluid. The fluid and/or gas can be selected and/or varied during the shearing process to engineer the properties of the shell and/or the order of the shell layers as the droplet is formed. That is, the formation of the shell can be performed in a chemically dynamic (e.g., changing gas flow rate, gas composition, gas partial pressure, temperature, fluid composition) and mechanically dynamic (e.g., changing shear speed, shear stress, etc.) environment that can be optimized to form a particular shell composition.

In step 320 a shell can be formed around each droplet. In some embodiments the shell can include more than one layer where each layer can be defined by the predominant concentration of a different element. During formation of the shell, elements that are dispersed in the bulk can be stabilized on the surface of the core due to their potential to be oxidized and/or their stronger affinity to the fluid. Internal movement and diffusion of the elements within the core bring them to the surface and the reaction and stabilization at the surface cause them to remain at the surface to build the shell, as discussed in greater detail below.

In one embodiment the fluid and one or more of the elements can be selected to have a higher propensity for bonding than the propensity of the one or more elements have to form oxides. That is, the fluid and the elements can be engineered to preferentially react. Thus, the element with the highest propensity to react with the fluid will form the outermost layer, the element with the next highest propensity to react with the fluid will form the middle layer and the element with the next highest propensity to react with the fluid will form the innermost layer. In one example an ammonia-based fluid can be selected to preferentially react with transition metals. In another example a sulfur-based fluid can be selected to preferentially react with gold and a carboxylic acid-based fluid can be selected to preferentially react with indium while a phosphate can be selected to referentially react with gallium.

In various embodiments the solid shell can be exposed to one or more chelating agents to remove at least a portion of the outermost layer. In some embodiments the one or more chelating agents comprises at least one of a carboxylate, an amide, an alkoxide, an amine, a thiol or a phosphate, however other suitable chelating agents can be used.

In another embodiment the one or more elements can be selected to have a higher propensity for forming an oxide than the propensity of the elements to react with the fluid. Thus, each layer can be arranged according to the reduction potential $E^o$ of the predominant element within that layer, relative to the reduction potential of the predominant element in the other layers. More specifically, cohesive energy density and partial miscibility can be used to "select" a lower $E^o$ element that is then pushed to the surface of the core to form the shell during processing. This lower $E^o$ element can be completely removed from the bulk of the core, substantially removed from bulk of the core or partially removed from the bulk of the core depending upon the desired final concentration of this element in the core and in the shell. This can be controlled by selecting the fluid properties, oxidant concentration, partial pressure and/or processing parameters such as temperature, time, etc.

In further embodiments the shell can be formed using a competition between the reduction potential one or more elements and the reaction potential with the fluid to engineer a multilayer shell with a specific arrangement of shell layers and layer compositions. More specifically, the highest potential for reaction may be for element A to react with the fluid, the next highest reaction potential may be for element B to react with oxygen to form an oxide, the next highest reaction potential may be for element C to react with the fluid, etc. Thus, any organization of and composition of layers within shell can be engineered by selecting the appropriate elements, fluid and/or gas.

In some embodiments a particular amount of an element (e.g., element B) can be included in a molten solution (e.g., where the molten solution includes element A and element B) that preferentially forms a portion of the shell such that none, or nearly none of element B is left in the liquid core of each droplet whereby the core is substantially 100 percent element A. In some embodiments the elements may be miscible (e.g., go into solution with each other) while in other embodiments one or more of the elements may be immiscible and form an interstitial material that does not go into solution with the base metal. In embodiments having an immiscible element, removing all or almost all of the immiscible element from the core (i.e., moving it out of the core to form the shell) may increase the amount of undercooling in embodiments where the particular element can precipitate out of solution in the core, causing nucleation and subsequent solidification of the core. To remove element B from the core to form the shell, the fluid and/or gas can be selected to have a high potential for a reaction with element B and a low potential for a reaction with element A such that the shell is preferentially formed from element B. In further embodiments the time and temperature can be adjusted during the shell formation to enable the majority or all of element B to diffuse to the shell. In further embodiments a portion of or substantially all of element B can be leached out of the bulk.

In some embodiments the miscibility and reduction potentials are exploited to constitute alloys that will, under these dynamic processing conditions, allow the element having the highest oxidation/reduction potential to enrich the exterior surface of the shell. Where this component is not highly soluble relative to the other alloy components (e.g., In in Sn vs Ge, or Bi in In vs Ge), the propensity to be on the surface can be increased. In some embodiments modified. Darken-Gurry plots and/or Hume-Rothery rules can be used to predict solubility in the bulk and to correct these solubility parameters by their probability to partition to the surface to predict the final alloy composition.

In further embodiments the particular compounds that are formed can be controlled by controlling the time and temperature during shell formation. For example, when forming tin oxide, using a relatively short time and/or low temperature preferentially forms 2+ tin oxide and a relatively longer time and/or higher temperature preferentially forms 4+ tin oxide.

In step 325 the droplets, which each include a shell, are cooled below a solidus temperature of the core material. That is, the composition of the core, after formation of the shell, has a particular solidus temperature and due to the lack of nucleation sites on the inner surface of the shell and/or the concentration gradient of the shell the liquid metal core can be cooled below its solidus temperature without causing the core to transition to a solid state. In some embodiments the droplets are coated in a fluid that protects the shell from degradation. In various embodiments the droplets are approximately 1 micron in diameter, however in other embodiments they are between 0.5 microns and 10 microns and in another embodiment are between 0.25 microns and 100 microns in diameter.

It will be appreciated that method 300 is illustrative and that variations and modifications are possible. Steps described as sequential may be executed in parallel, order of steps may be varied, and steps may be modified, combined, added or omitted.

Figure 4:
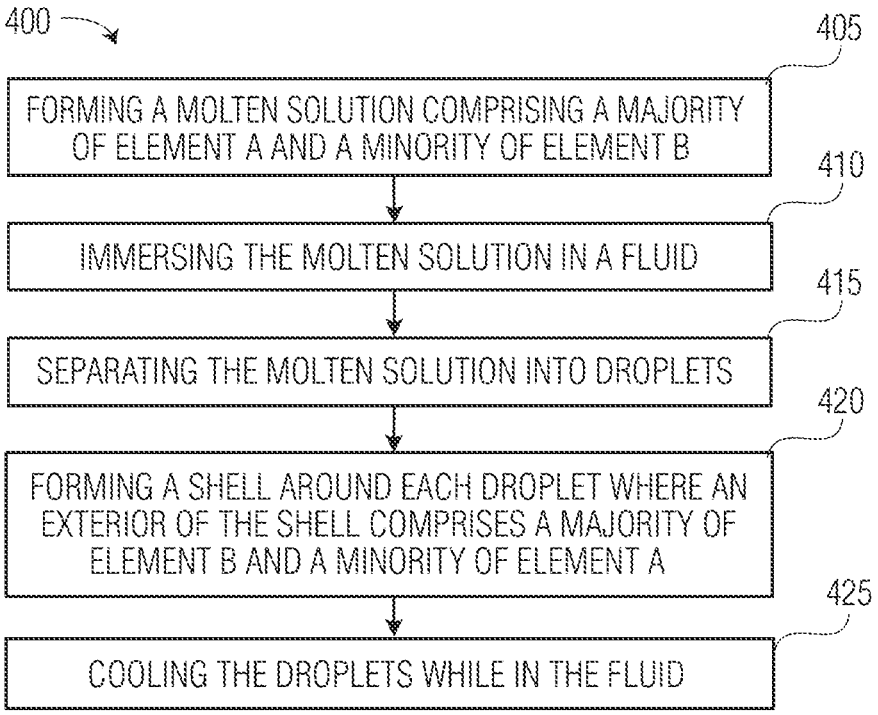
FIG. 4 illustrates steps associated with a method of forming undercooled droplets comprising a liquid metallic core enclosed by a solid shell that includes an exterior surface having a composition that is different than the liquid metallic core, according embodiments of this disclosure.

FIG. 4 illustrates steps associated with a method 400 of forming undercooled droplets comprising a liquid metallic core enclosed by a solid shell that includes an exterior surface having a composition that is different than the liquid metallic core, according embodiments of this disclosure. As described in FIG. 4, in step 405 a molten solution comprising a majority of element A and a minority of element B is prepared. In some embodiments the molten solution can be formed by heating up element A and adding element B. In other embodiments element A and element B may already be mixed but exist as a solid which can be simply heated up to form the molten solution.

In step 410 the molten solution from step 505 is immersed in a fluid. In some embodiment the fluid includes a conjugate acid-base pair where the acid component is configured to in situ polish the shell and the base is configured to stabilize the shell against physi- and chemi-sorption. More specifically, in one embodiment the acid component smooths the interior surface of the shell to minimize nucleation sites that can cause the liquid metal core to solidify when cooled below the solidus temperature. In other embodiments other types of fluids can be used. In further embodiments one or more gasses can be added to the fluid such as, but not limited to oxygen.

In step 415 the molten solution can be separated into droplets while immersed in the fluid and/or gas. In some embodiments the molten solution can be separated using a mechanical shearing apparatus such as a high speed blade that is immersed in the fluid. During shearing, each droplet is surrounded by the fluid and/or gas. The fluid and/or gas can be selected to engineer the properties of the shell and/or the droplet, as explained in more detail below.

In step 420 a shell can be formed around each droplet. In some embodiments the shell can include more than one layer where each layer can be defined by the predominant concentration of a different element. In some embodiments the liquid metal core includes a majority of element A and a minority of element B, while the exterior surface of the shell includes a majority of element B and a minority of element A. As described above in step 320, various methods can be used to selectively engineer the composition and arrangement of each layer.

In step 425 the droplets, which each include a shell, are cooled below a solidus temperature of the core material. That is, the composition of the core, after formation of the shell, has a particular solidus temperature and due to the lack of nucleation sites on the inner surface of the shell and/or the concentration gradient of the shell the liquid metal core can be cooled below its solidus temperature without causing the core to transition to a solid state. In some embodiments the droplets are coated in a fluid that protects the shell from degradation. In various embodiments the droplets are approximately 1 micron in diameter, however in other embodiments they are between 0.5 microns and 10 microns and in another embodiment are between 0.25 microns and 100 microns in diameter.

In one embodiment a solder alloy known as SAC305 that includes tin, silver and copper is doped with germanium such that the core of the droplet is substantially SAC305 and the exterior of the shell is predominately germanium. In another embodiment an alloy of bismuth and tin is doped with germanium and the exterior of the shell is predominantly germanium.

In further embodiments after the droplets are formed they can be subjected to temperatures to increase the amount of undercooling they can withstand, as described in more detail below.

It will be appreciated that method 400 is illustrative and that variations and modifications are possible. Steps described as sequential may be executed in parallel, order of steps may be varied, and steps may be modified, combined, added or omitted.

2-Layer Shell in Reducing Environment

Figure 5A:
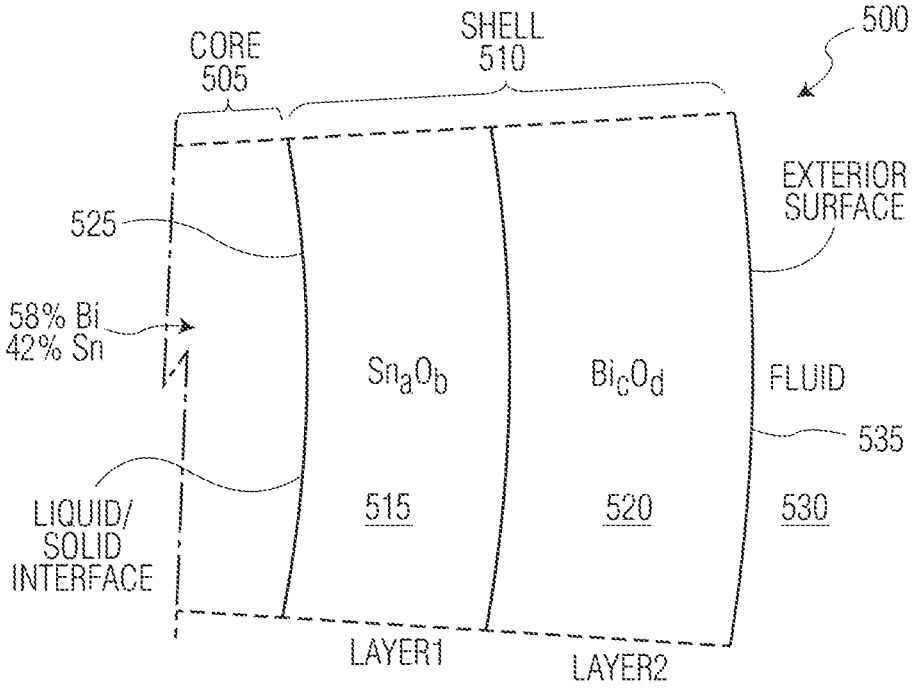
FIG. 5A illustrates a partial cross-sectional view of one example of a droplet having a two layer shell formed in a reducing environment, according to embodiments of the disclosure.

FIG. 5A illustrates a partial cross-sectional view of one example of a droplet having a two layer shell formed in a reducing environment, according to embodiments of the disclosure. Droplet 500 in FIG. 5A is similar to droplet 200 in FIG. 2A, where the core includes the same constituent elements in similar concentrations, however droplet 500 is formed in a reducing environment so instead forming bismuth oxide on the outer surface like droplet 200, droplet 500 forms tin oxide on the outer surface.

As shown in FIG. 5A, liquid metallic core 505 of droplet 200 is predominantly elemental bismuth (Bi) with residual elemental tin (Sn). In the embodiment depicted in FIG. 5A core 505 includes 58 weight percent Bi and 42 weight percent Sn, however in other embodiments these elements can have any other suitable ratio. For example, in one embodiment core 505 includes 95 weight percent Bi and 5 weight percent Sn. In some embodiments liquid metallic core 505 is a single metallic element while in other embodiments it can be an alloy of a plurality of metallic elements or a combination of metallic, semi-metallic, metalloid and/or non-metallic elements, as described in further detail below. As further shown in FIG. 5A, core 505 includes a shell 510 having two layers where layer 1 (515) is an innermost layer and layer 2 (520) is an outermost layer. In the example shown in FIG. 5A, layer 1 (525) is predominately composed of tin oxide ($Sn_cO_d$ where c and d are any rational number) and layer 2 (220) is predominately composed of bismuth oxide ($Bi_aO_b$ where a and b are any rational number). In some embodiments each layer 515, 520 can have a concentration gradient of multiple metal oxides and can be defined by a predominant metal oxide (e.g., layer 1 (515) is predominantly tin oxide and layer 2 (520) is predominantly bismuth oxide, as described in more detail below.

An interior surface 525 of layer 1 (515) can have a relatively smooth surface free from nucleation sites, preventing nucleation and growth (i.e., phase transformation) of liquid metallic core 505 from transitioning to a solid at temperatures below the solidus temperature of the core material (e.g., below 138° C. for eutectic 58Bi42Sn). In some embodiments, the concentration gradients within shell 510 can create a thermodynamic tension that generates an increased energy barrier for liquid to solid phase transformation to occur, thereby increasing the stability of liquid metallic core 505 within the liquid state even further below its solidus temperature.

Figure 5B:
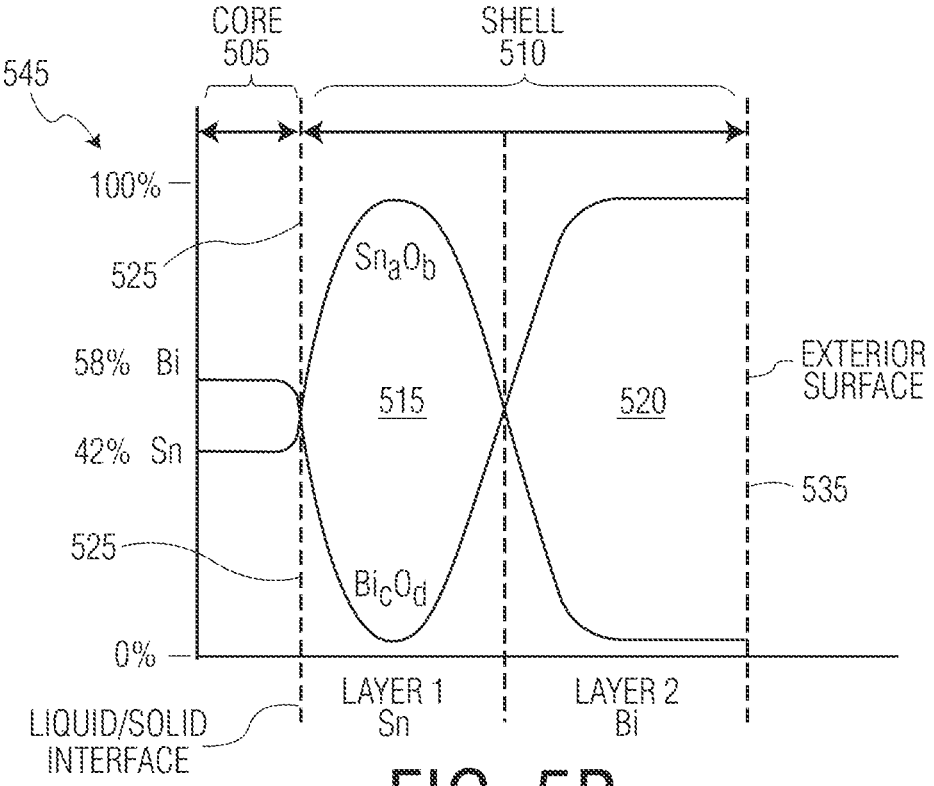
FIG. 5B illustrates an example concentration gradient graph of the relative concentrations of each element and oxides thereof (e.g., Sn and Bi) with regard to the cross-section of the droplet illustrated in FIG. 5A.

FIG. 5B illustrates an example concentration gradient graph of the relative concentrations of each element and oxides thereof (e.g., Sn and Bi) with regard to the cross-section of droplet 500 illustrated in FIG. 5A. These concentration gradients are for example only and other embodiments can have different elements and/or different concentration gradients. As shown in concentration graph 545 of FIG. 5B, starting at the left-hand portion of the graph within liquid core 505, the concentration of elemental Sn is relatively constant, near 42% and the concentration of elemental Bi is also relatively constant, near 58%.

Progressing into layer 1 (515) (i.e., towards the right in concentration graph 545 of FIG. 5B) first, the elemental Sn and Bi exist as oxides (e.g., $Sn_aO_b$ and $Bi_cO_d$) and the concentration of both elements (e.g., the oxides thereof) rapidly changes where tin oxide increases to approximately 90% while bismuth oxide decreases to approximately 10% in the middle portion of layer 1 (515). Thus within layer 1 (515) the concentration of Sn is greater than Bi so layer 1 can be identified as having a majority of Sn and a minority of Bi.

Now progressing into layer 2 (520) the composition of tin oxide continues to decline to approximately 10% while the concentration of bismuth oxide reaches a maximum at approximately 90%. Thus at an exterior surface 535 of shell 510, bismuth oxide has a greater concentration than tin oxide. In some embodiments, during the formation of shell 510 the environment may be a so-called "reducing environment" that promotes the formation of bismuth oxide on exterior surface 535 and may include one or more forms of reducing gases such as for example, hydrogen, carbon monoxide, and gases such as hydrogen sulfide that would be oxidized by any present oxygen. In some embodiments exterior surface 535 may be covered in a fluid 530 that stabilizes the exterior surface from oxidation and/or degradation, as described in more detail herein.

The concentration gradients within shell 510 can create a thermodynamic tension that frustrates phase transformation of liquid core 505 to a solid. In some embodiments core 505 may include a relatively minor percentage of other elements that may include, for example the element that dominates the exterior surface. As described herein, a minority percentage can be less than a comparative majority percentage. In further embodiments, the exterior surface may include a relatively small percentage (e.g., less than 50 percent, less than 10 percent, less than 1 percent) of other elements that may include, for example the element that dominates the core.

In some embodiments fluid 530 can present a physical barrier to physi- and chemi-sorption for shell 510. In yet further embodiments the exterior surface of shell 510 can be terminated in a relatively inert metal such as, for example gold, silver, nickel or platinum. In one embodiment the exterior surface may be stable without a fluid, gas or termination.

3-Layer Shell in Oxidizing Environment

Figure 5C:
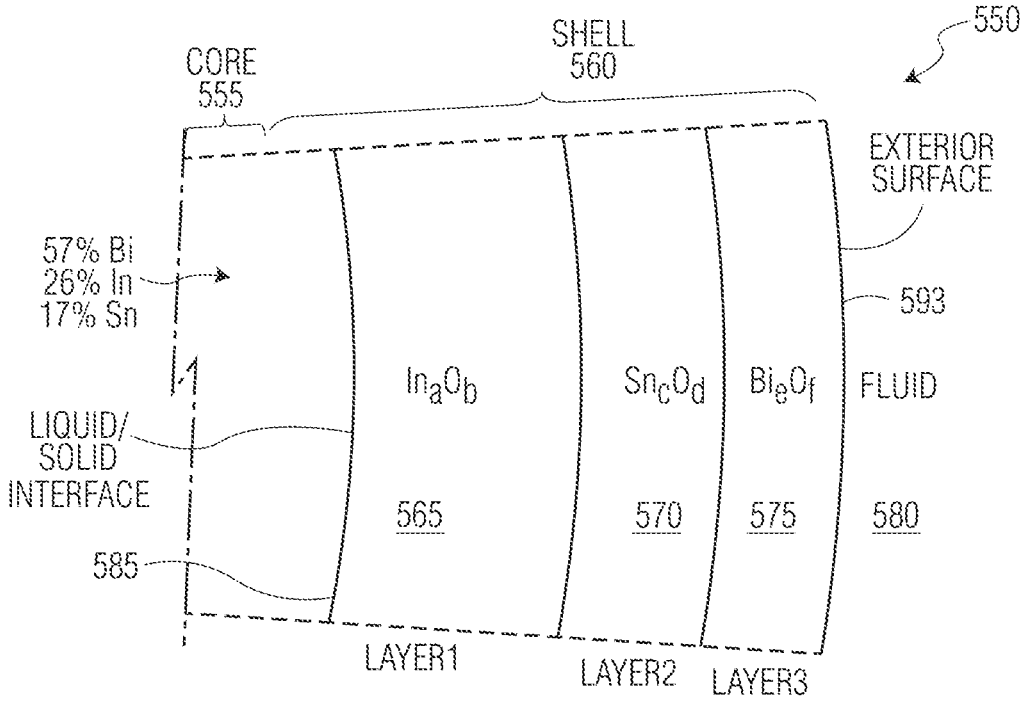
FIG. 5C illustrates a partial cross-sectional view of one example of a droplet having a three layer shell formed in a reducing environment, according to embodiments of the disclosure.

FIG. 5C illustrates a partial cross-sectional view of one example of a droplet having a three layer shell formed in a reducing environment, according to embodiments of the disclosure. Droplet 550 in FIG. 5C is similar to droplet 250 in FIG. 2C, where the core includes the same constituent elements in similar concentrations, however droplet 550 is formed in a reducing environment so instead forming indium oxide on the outer surface like droplet 250, droplet 550 forms bismuth oxide on the outer surface.

As shown in FIG. 5C, liquid metallic core 555 of droplet 550 is predominantly elemental bismuth (Bi) with lesser amounts of elemental indium (In) and tin (Sn). In the embodiment depicted in FIG. 5C core 555 includes 57 weight percent Bi, 26 weight percent In and 17 weight percent Sn, however in other embodiments these elements can have any other suitable ratio. In some embodiments liquid metallic core 555 is a single metallic element while in other embodiments it can be an alloy of a plurality of metallic elements or a combination of metallic, semi-metallic, metalloid and/or non-metallic elements, as described in further detail below. As further shown in FIG. 5C, core 555 includes a shell 560 having three layers where layer 1 (565) is an innermost layer, layer 2 (570) is an intermediate layer and layer 3 (575) is an outermost layer. In the example shown in FIG. 5C, layer 1 (565) is predominately composed of indium oxide ($In_aO_b$ where a and b are any rational number), layer 2 (570) is predominately composed of tin oxide ($Sn_cO_d$ where c and d are any rational number) and layer 3 (575) is predominately composed of bismuth oxide ($Bi_eO_f$ where e and f are any rational number). In some embodiments each layer 565, 570, 575 can have a concentration gradient of multiple metal oxides and can be defined by a predominant metal oxide (e.g., layer 1 (565) is predominantly Indium oxide, layer 2 (570) is predominantly tin oxide and layer 3 (575) is predominantly bismuth oxide, as described in more detail below.

An interior surface 585 of layer 1 (565) can have a relatively smooth surface free from nucleation sites, preventing nucleation and growth (i.e., phase transformation) of liquid metallic core 555 from transitioning to a solid at temperatures below the solidus temperature of the core material (e.g., below 62° C. for 57Bi26In17Sn). In some embodiments, the concentration gradients within shell 560 can create a thermodynamic tension that generates an increased energy barrier for liquid to solid phase transformation to occur, thereby increasing the stability of liquid metallic core 555 within the liquid state even further below its solidus temperature.

Figure 5D:
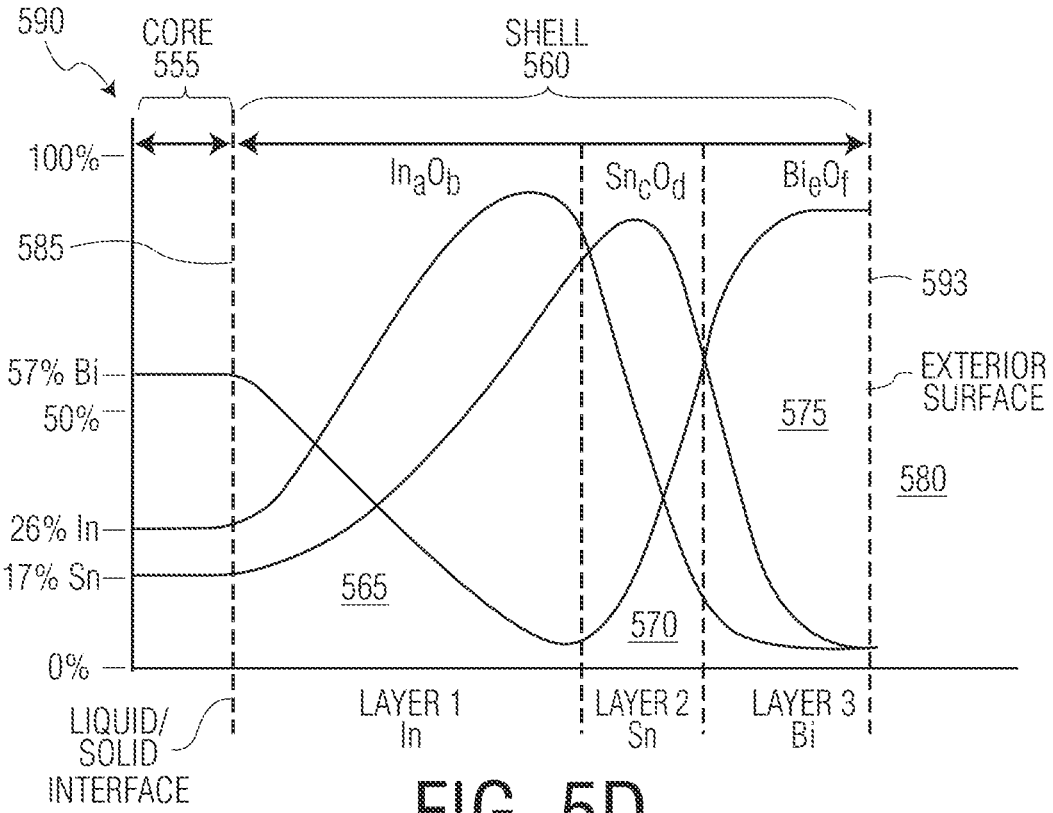
FIG. 5D illustrates an example concentration gradient graph of the relative concentrations of each element and oxides thereof (e.g., Bi, Sn and In) with regard to the cross-section of the droplet illustrated in FIG. 5C.

FIG. 5D illustrates an example concentration gradient graph of the relative concentrations of each element and oxides thereof (e.g., Bi, Sn and In) with regard to the cross-section of droplet 550 illustrated in FIG. 5C. These concentration gradients are for example only and other embodiments can have different elements and/or different concentration gradients. As shown in concentration graph 590 of FIG. 5D, starting at the left-hand portion of the graph within liquid core 55, the concentration of elemental Bi is relatively constant near 57%, the concentration of elemental In is relatively constant near 26% and the concentration of elemental Sn is also relatively constant near 17%.

Progressing into layer 1 (565) (i.e., towards the right in concentration graph 590 if FIG. 5D) first, the elemental Bi, Sn and In and exist as oxides (e.g., $In_aO_b$, $Sn_cO_d$ and $Bi_eO_f$) and the concentration of each element (e.g., the oxides thereof) changes where indium oxide increases to dominate, while tin oxide increases at a slower rate and bismuth oxide decreases. Towards the right side of layer 1 (565) the concentration of indium oxide is greater than that of tin oxide and indium oxide, thus layer 1 (565) can be identified as having a majority of In.

Now progressing into layer 2 (570) the composition of indium oxide declines while the concentration of tin oxide increases to dominate layer 2. Thus layer 2 (570) can be identified as having a majority of tin. Now progressing into layer 3 (575) the composition of tin oxide and indium oxide decline while bismuth continues to increase and dominate layer 3. Thus layer 3 (575) can be identified as having a majority of bismuth. Therefore, at an exterior surface 593 of shell 560, bismuth oxide has a greater concentration than indium oxide or tin oxide. In some embodiments, during the formation of shell 510 the environment may be a so-called "reducing environment" that promotes the formation of bismuth oxide on exterior surface 593 and may include one or more forms of reducing gases such as for example, hydrogen, carbon monoxide, and gases such as hydrogen sulfide that would be oxidized by any present oxygen. In some embodiments exterior surface 593 may be covered in a fluid 580 that stabilizes the exterior surface from oxidation and/or degradation, as described in more detail herein.

The concentration gradients within shell 560 can create a thermodynamic tension that frustrates phase transformation of liquid core 555 to a solid. In some embodiments core 555 may include a relatively minor percentage of other elements that may include, for example the element that dominates the exterior surface. As described herein, a minority percentage can be less than a comparative majority percentage. In further embodiments, the exterior surface may include a relatively small percentage (e.g., less than 50 percent, less than 10 percent, less than 1 percent) of other elements that may include, for example the element that dominates the core.

In some embodiments fluid 580 can present a physical barrier to physi- and chemi-sorption for shell 560, as described in further detail above. In yet further embodiments the exterior surface 593 of shell 560 can be terminated in a relatively inert metal such as, for example gold, silver, nickel or platinum. In one embodiment the exterior surface may be stable without a fluid, gas or termination.

The relative concentrations of Sn, In, Bi and the related oxides shown in FIGS. 5A-5D are for illustrative examples only. One of skill in the art having the benefit of this disclosure will appreciate that other embodiments may have different relative concentrations and/or different elements.

Frustrating Phase Transitions Through Surface Asymmetry

Surface speciation and autonomous differentiation in metals is can be influenced by miscibility, reactivity, and environment. Under unreactive environment surface speciation can be influenced by flux, cohesive energy density and surface energy minimization. Under oxidizing (e.g. ambient) conditions, reduction potential, curvature, and surface plasticity play a role and influence surface organization and stoichiometry. This speciation can alter a material's energy landscape through surface work asymmetries. This complex surface architecture offers an active platform based on asymmetry in the surface structure, and its induced effect on solubility, which can be utilized to frustrate liquid-solid transition. Induced interfacial order renders Cahn-Hilliard type diffusion unfavorable, hence frustrates homogeneous nucleation. In-situ formation surface passivating oxides with concomitant size reduction traps molten metal in a 'containerless' state (since the oxide is a continuum from the bulk) while establishing a physical barrier to heterogeneous nucleant(s). Engineering the distribution of components across a metal particle and its surface can have an effect on the degree of undercooling and provide a generalized approach to frustrating undercooling.

Figure 6A:
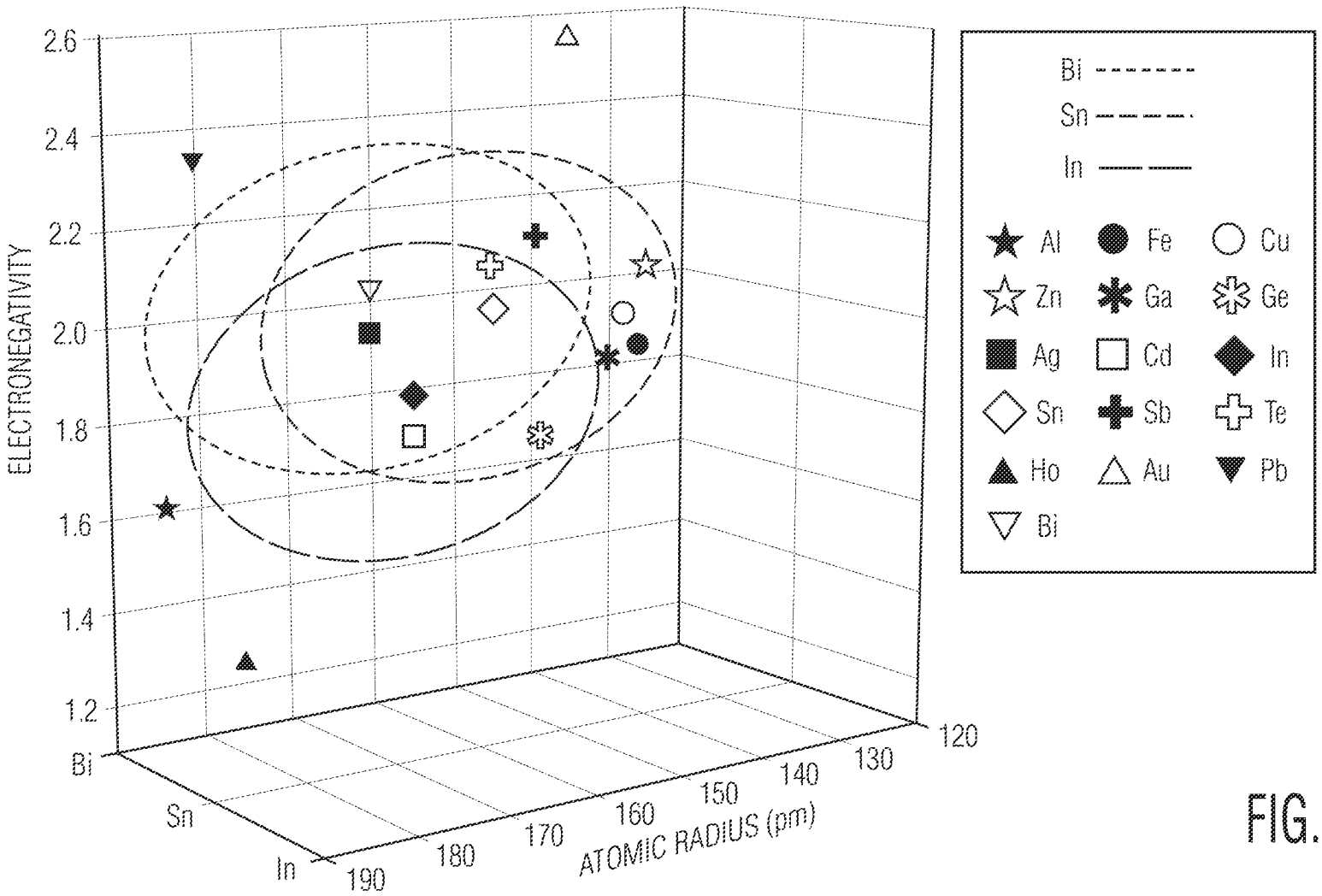
FIG. 6A illustrates a Darken-Gurry plot overlayed and compared to a redox-dictated analog, according to embodiments of the disclosure.

Homogeneous materials mixing can be understood from discipline specific rules. In metals (entropy dominated) solid solutions can be understood via Hume-Rothery rules which are often captured in 2-dimensional Darken-Gurry plots (FIG. 6A). In metals, a focus on solid solution can be driven by structural use of these materials, yet often, a molten liquid phase is needed for ease of processing. This need has been exacerbated by advances in flexible, wearable and bio-electronics, albeit at reduced temperature as most substrates are incompatible with temperatures greater than 100° C. Liquid-solid (L-S) phase transition can be considered in enabling new applications of metals especially in hybrid/mixed material systems. This transition is, however, dependent on underlying kinetics and thermodynamics. Kinetically, diffusion can be important for nucleation and growth hence, rapid quenching is often used to form metastable states like glass or undercooled liquids.

Thermo-dynamically, nucleant (exogeneous or homogeneous) lower the activation barrier abetting L-S phase transformation. Where the nucleation barrier is high or Cahn-Hilliard type diffusion is unfavorable, the L-S transitions can be thermo-dynamically frustrated. Heterogeneous (exogeneous source) nucleation can be eliminated via the container-less approach or via surface barriers like a passivating oxide. High entropy favors the liquid phase and significantly decreases the probability of homogeneous nucleation. High entropy can be attained through composition or via dimergence in the distribution of microstates occupied by components of an alloy. High surface area-to-volume ratio, for example in nanoparticles, can lead to limited homogeneous nucleation. Felicitous choice of dimensions, coupled to surface organization and speciation across the passivating oxide can induce divergence in density of energy states (microstates) that alloy components can occupy. This divergence in energy states can lead to perturbation of the bulk's energy landscape (akin to the nanoparticles), hence can be used to tune diffusion and equilibrium state(s). The oxidation process can be an integral component in understanding of miscibility and the L-S phase transition for metal powders prepared at ambient.

Figure 6B:
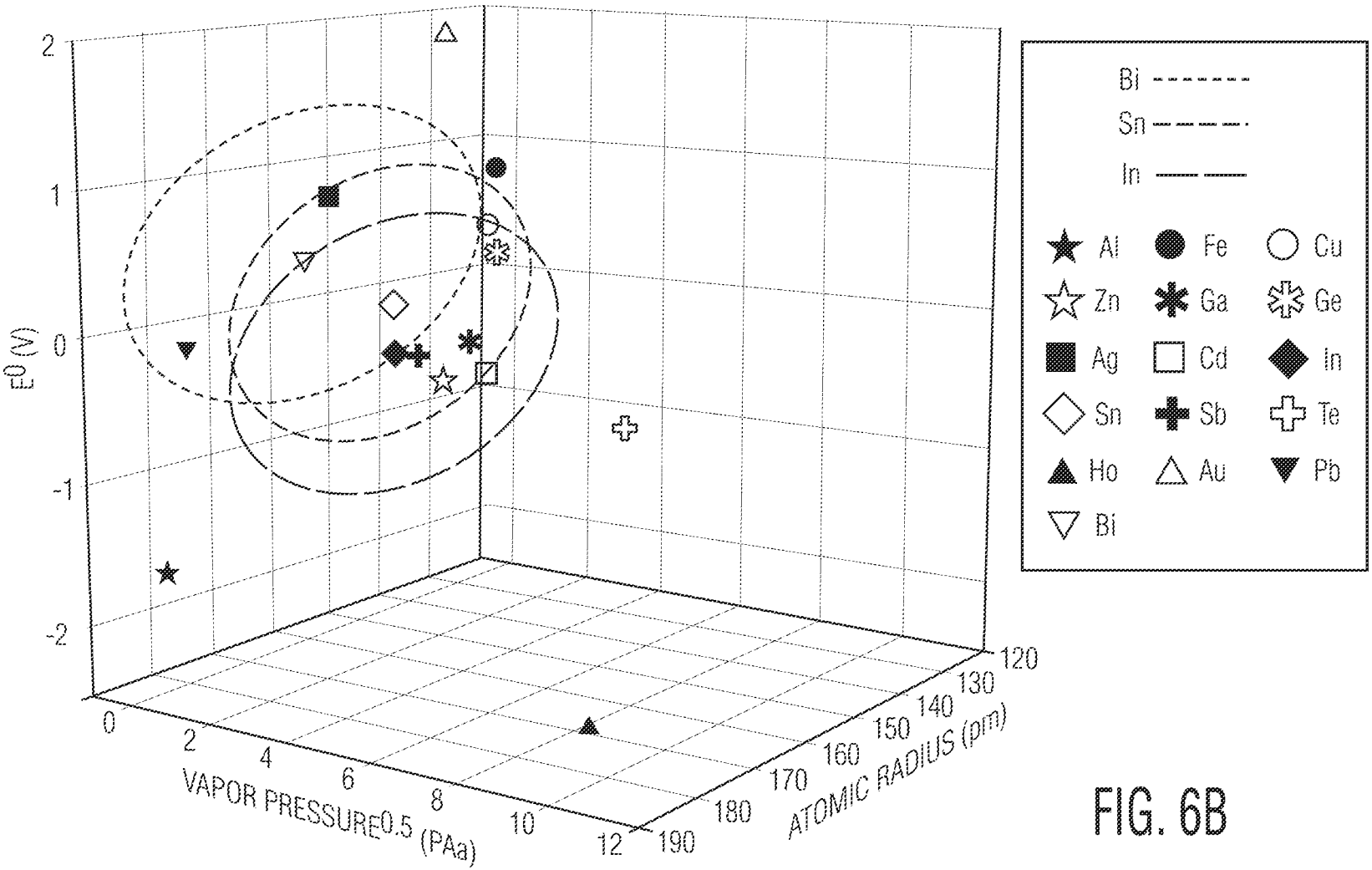
FIG. 6B is the plot of FIG. 6A with the introduction of $E^o$ and vapor pressure, according to embodiments of the disclosure.

Redefining Darken-Gurry plots in an oxidizing environment may involve substituting valency with standard reduction potential ($E^0$), and cohesive energy density (CED). Considering an example, for explanatory purposes only, of Bi, In, Sn, the Darken-Gurry plot (FIG. 6A) is overlayed and compared to a redox-dictated analog (FIG. 6B). In FIG. 6B, introduction of $E^o$ and vapor pressure (in lieu of CED) allows the prediction of surface speciation. With the modified Darken-Gurry plot, a so-called preferential interaction parameter (PIP) is defined by a region in a 3-dimensional plot where overlapping regions imply solubility. The $E^0$ component dominates the surface. In one example, in Field's metal (BiInSn), a predominantly $In_2O_3$ shell should form, but with a significant incorporation of Sn sub-oxides, hence interfacial Bi should segregate underneath the oxide shell. This segregated Bi is, however, occupies a trapped state since it is energetically costly to dissolve in the bulk as it pushes the mixture off eutectic. Introducing an immiscible but significantly lower $E^0$ element like Te leads to a $TeO_2$ shell and likely with minor perturbation to the eutectic composition but with an induced surface speciation (FIG. 6A). This speciation leads to increased thermodynamic stress, hence a higher likelihood to frustrate L-S phase transition.

On the contrary, introduction of a high $E^0$ component like Au (FIG. 6B) confines it to the bulk, where the large difference in $E^0$ likely leads to formation of intermetallics abetting homogeneous nucleation hence poor undercooling. Surface-driven thermodynamic tuning of the L-S transition can be achieved by: i) establishing a smooth passivating oxide shell on the surface of molten metals, ii) by engineering this oxide shell through felicitous choice of alloy composition, processing temperature (to control thickness), and surface ligands and iii) achieving this organization while the metal is superheated and under mechanical stress then rapidly cooling to near the melting point of the alloy followed by ambient cooling. Felicitous choice of processing conditions and management of the relaxation energy landscape can lead to frustrated solidification. Similarly, the activation energy can be lowered leading to tunable solidification based on divergence (asymmetry) in surface microstate distributions.

Figure 7A:
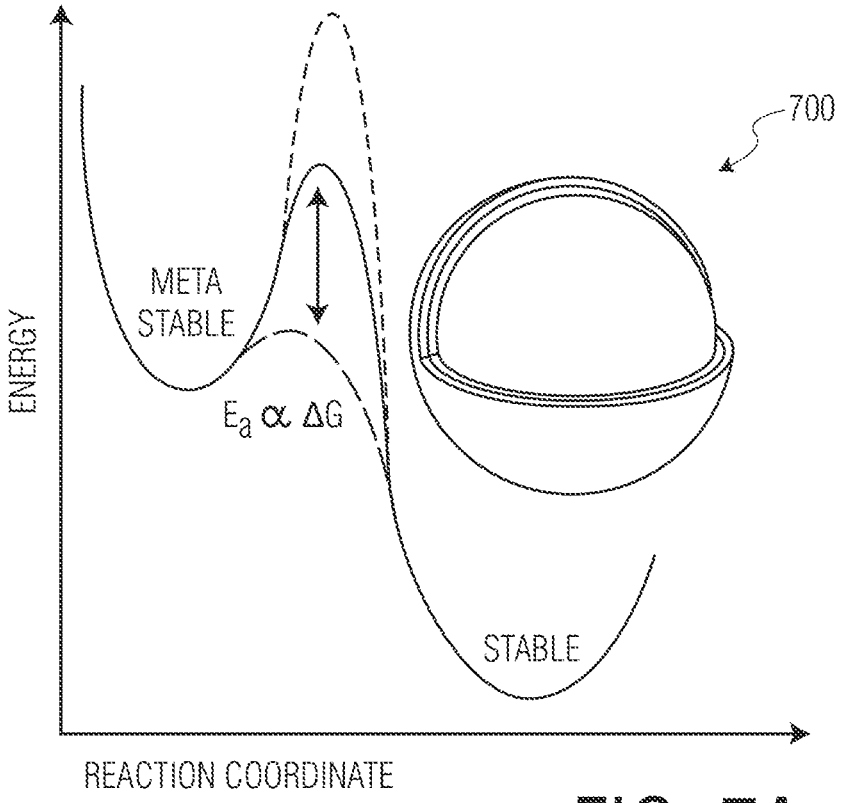
FIG. 7A is a schematic illustration of surface tunable frustration of solidification of core-shell metal particles, according to embodiments of the disclosure.
Figure 7B:
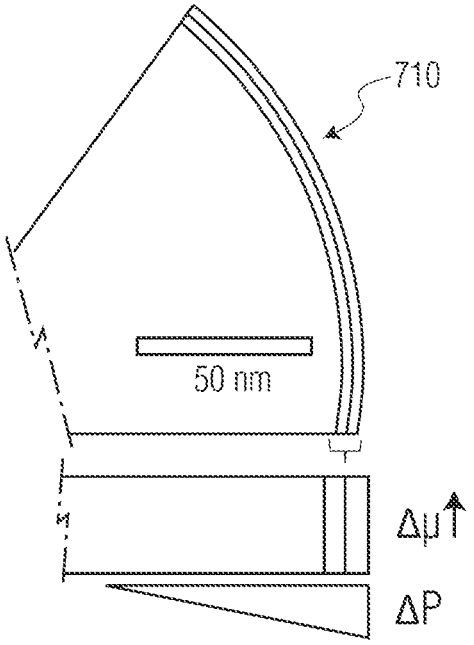
FIG. 7B is a high-angle annular dark-field scanning transmission electron microscopy image of a shell, according to embodiments of the disclosure.
Figure 8:
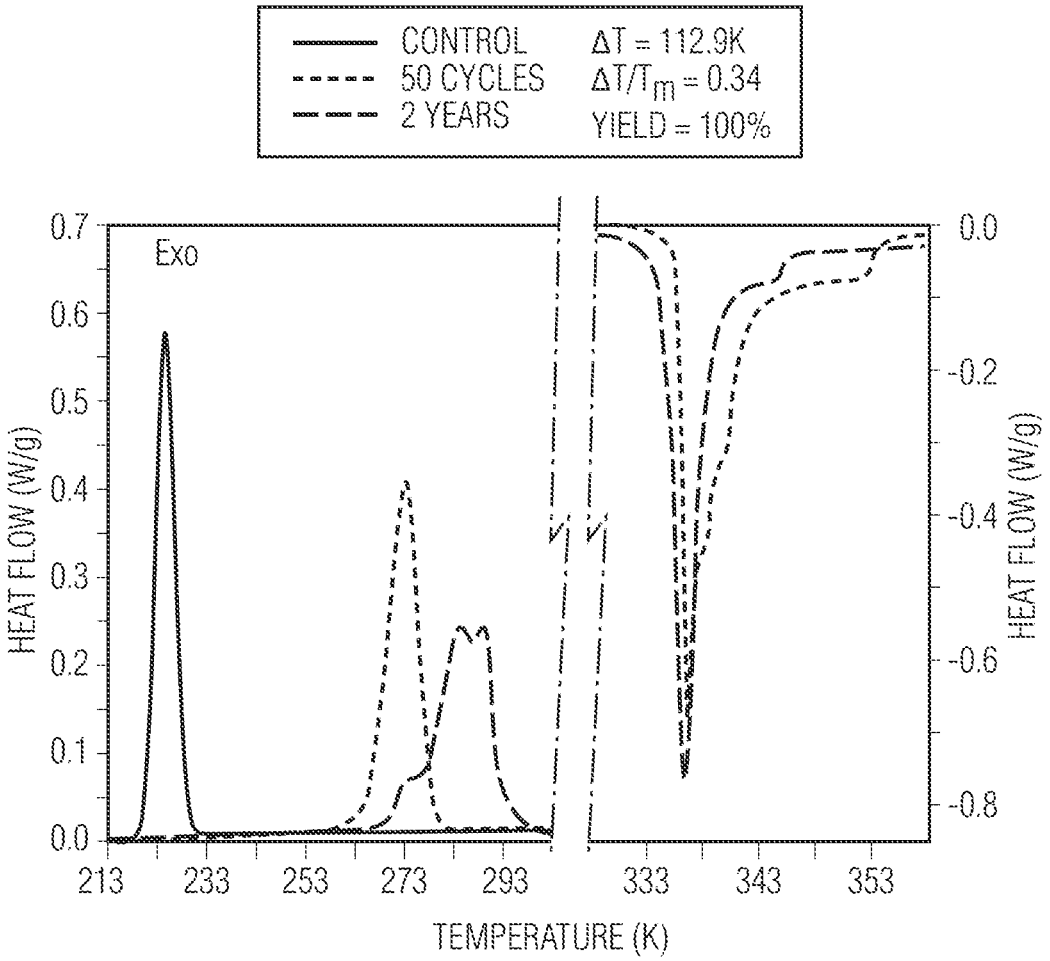
FIG. 8 shows the stability of undercooled Fields metal particles, according to embodiments of the disclosure.

FIG. 7A is a schematic illustration of surface tunable frustration of solidification of core-shell metal particles 700. FIG. 7B is a high-angle annular dark-field scanning transmission electron microscopy (HAADF-STEM) Sobel filter analysis on oxide thickness of shell 710. Since the surface properties may not be dynamic, the produced metastable states should be stable for prolonged periods of time and should be resilient to variable handling conditions if the oxide layer is not broken. FIG. 8 shows the stability of undercooled Fields metal particles (in conditions of approximately 2 years storage and 50 thermal cycles) prepared via this approach. FIG. 8 illustrates differential scanning calorimetry (DSC) trace of field's metal particles under different conditions.

Background

Undercooled liquids are a metastable phase due to frustrated liquid-solid transition. The free energy change during L-S phase transition can be defined by;

$$\Delta G_{LS} = \left[\frac{\Delta H_f \Delta T}{T_m} - \int_T^{T_m} \Delta C_p(T)dT + T\int_T^{T_m} \frac{\Delta C_p(T)}{T}dT\right] - \left[\int_T^{T_m}\left(\sum_{i=1}^{n} \Gamma_i d\mu_i\right)dT\right] \quad (1)$$

where ΔHf is enthalpy of fusion, Tm is melting temperature, ΔT is temperature difference between melting and freezing points (ΔT/Tm being the degree of undercooling), Cp is heat capacity, Γi is interfacial excess and μi is chemical potential of surface component i. The first half of this equation (the classical form) captures bulk enthalpy-entropy balance as the driving force of phase transition. The latter half of the equation (a correction for surface anisotropy) captures surface work, akin to Gibbs-Duhem equation albeit with consideration that passivating oxides in metal alloys constitute a compositionally anisotropic and flux-differentiated/speciated (due to redox, cohesive energy density and atomic radius) assemblies. Contribution of this self-sorting interfacial layer in the overall energy of the material can, therefore, be captured as a summation, over all surface, of contribution of each component in the thin (~0.7-4 nm) oxide layer to changes in chemical potential, Δμ. Until recently, entropic limitations of the surface (too thin relative to bulk) has typically implied that the surface can be ignored. Energetically, however, interfacial metastability can determine energy landscape of a material by inducing significant tension that can be overcome during phase change. This Δμ, however, changes with temperature as the material approaches the phase transition point. At ambient, the composition of the oxide layer undergoes irreversible changes with temperature rendering the approach to the phase transition point asymmetric, (e.g., total energy depends on the direction of the L-S transition). A significant increase in overall surface work, (e.g., through sharp concentration gradients, renders the change in Gibbs free energy ($\Delta G_{LS}$) positive hence tune energy barrier associated with the L-S transition.

In liquid droplets, Laplace pressure jump condition (ΔP=2γ/r; where γ=surface tension and r=radius) can cause mechanical equilibria but induces an asymmetry in the chemical potential below this oxide interface. The surface tension term (γ), by definition is the product of interfacial excess (Γ) and differences in chemical potential $$(\Delta\mu), d\gamma = \Sigma_{i=1}^{n}\Gamma_i d\mu_i \quad (2)$$

Liquid metals and associated oxides, however, are non-volatile hence $\Gamma_i$<<. Considering the circa 1-4 nm complex oxide on liquid metals, a steep concentration gradient renders surface terms a significant contributor to the pressure jump condition and associated thermodynamic potential of the bulk liquid metal. This complexity of interfacial excess and underlying Δμ implies that these surfaces can be used to engineer bulk PV-work under felicitous choice of processing conditions and alloy composition. By tuning surface architecture of molten metal droplets, with concomitant change in bulk composition, solid-liquid phase transition can be frustrated by; i) exploiting the self-organizing surface oxide as a 'container' to eliminate heterogeneous nucleation, and, ii) exploiting the chemical potential gradient due to the resulting complex oxide structure to frustrate homogeneous nucleation by creating an interface-driven asymmetry energy tension. This tension should be overcome for critical nucleus growth. Like entropy, this surface-driven tension increases the overall free energy hence further frustrates solidification (see equation 1). Considering that the composition and dimensions of the surface oxide evolves with time, stimuli, temperature, and diffusivity, the surface term evolves based on the processing conditions and alloy composition (e.g., component reactivity). Under a potentially large number of processing conditions, the effect of the surface on $\Delta G_{LS}$ can therefore be captured as $<\nabla\Gamma_i\mu_i>$.

It follows that as the complexity of the surfaces and interfaces increases, so does the ability to frustrate homogeneous nucleation (e.g., high activation energy, $\Delta E_a$). Metastable interfaces can perturb phase transition kinetics and can be the basis of the energy landscape inversion phase transition theory (LIPT). A similar overall energy landscape inversion is used here to synthesize and stabilize metastable undercooled liquid metal droplets.

Results

Figure 9A:
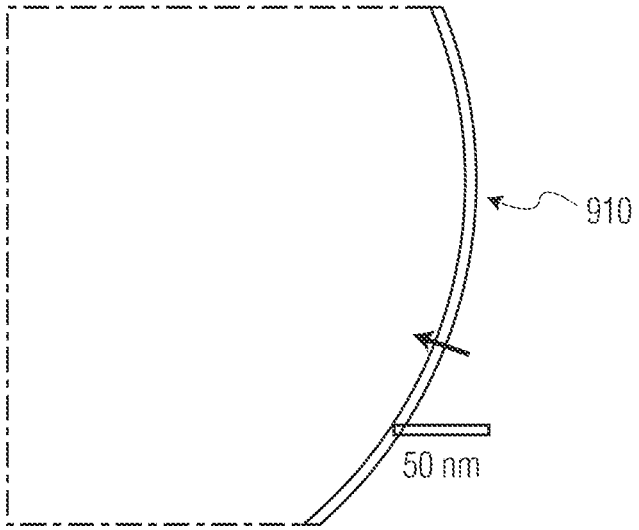
FIG. 9A illustrates a Sobel filter processed HAADF STEM image of a metal particle highlighting oxide thickness of the shell, according to embodiments of the disclosure.
Figure 9B:
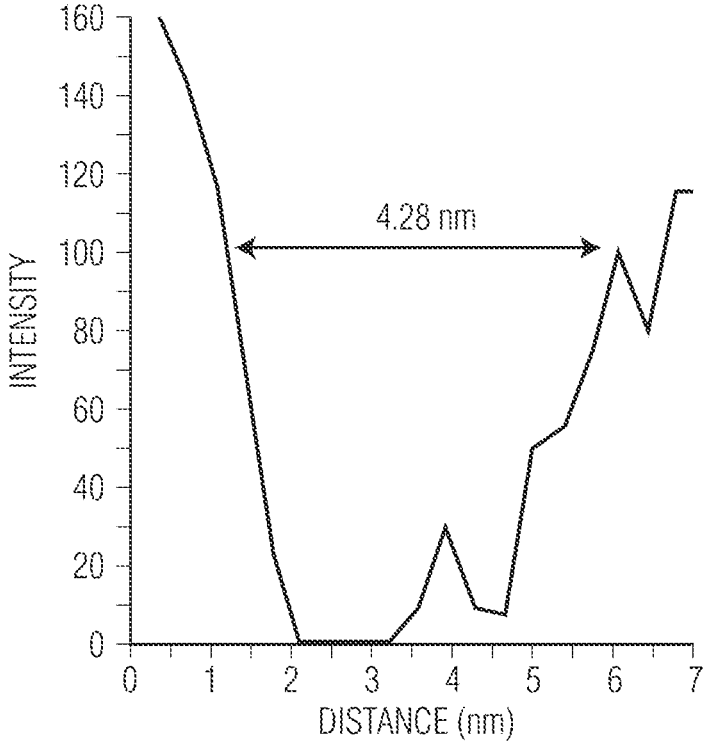
FIG. 9B illustrates an analysis of the oxide thickness of the shell of the metal particle shown in FIG. 9A.
Figure 9C:
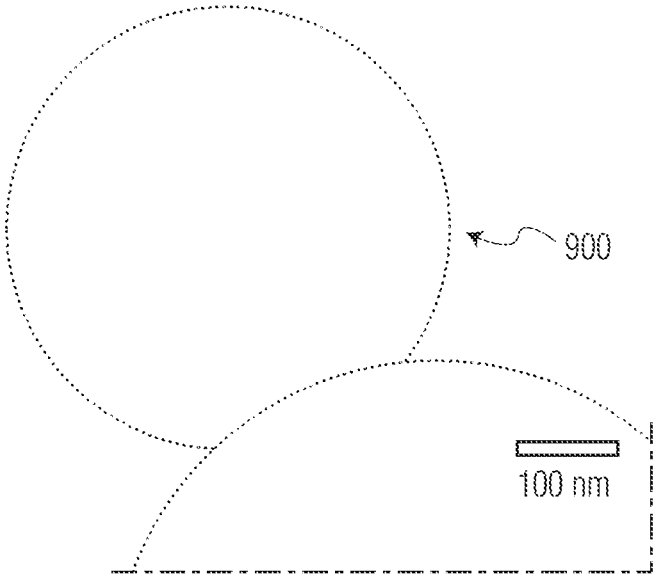
FIG. 9C illustrates a SEM image of the metal particle shown in FIG. 9A.

Undercooled core-shell metal particles were synthesized using the SLICE (Shearing Liquid into Complex Particles) method. For the majority of this work, Field's metal (32.5% Bi, 16.5% Sn and 51% In, Tm≈335 K) and eutectic bismuth-tin (58% Bi, 42% Sn, Tm≈411 K) were used as the base alloy, however this method can be used on other alloys. The molten ingot was sheared in presence of a conjugate acid-base pair to form ~1 μm diameter undercooled core-shell particles. The acid-base pair in situ polishes (acid) and stabilizes (base) the thin oxide shell (~4 nm, FIGS. 8A, 8B). FIG. 9A illustrates a Sobel filter processed HAADF STEM image of the metal particle highlighting oxide thickness of shell 910. FIG. 9B illustrates an analysis of the oxide thickness of the shell 910 of the metal particle shown in FIG. 9A. The as-synthesized particles were analyzed using DSC to assess degree of undercooling, yield, and purity. Other microscopy and spectroscopic methods (e.g. SEM in FIG. 9C) were used to characterize the particles 900. For Fields metal, the yield of undercooled particles was (>98%) while the degree of undercooling was ΔT/Tm≈0.34 for freshly made particles (FIG. 8).

Figure 9D:
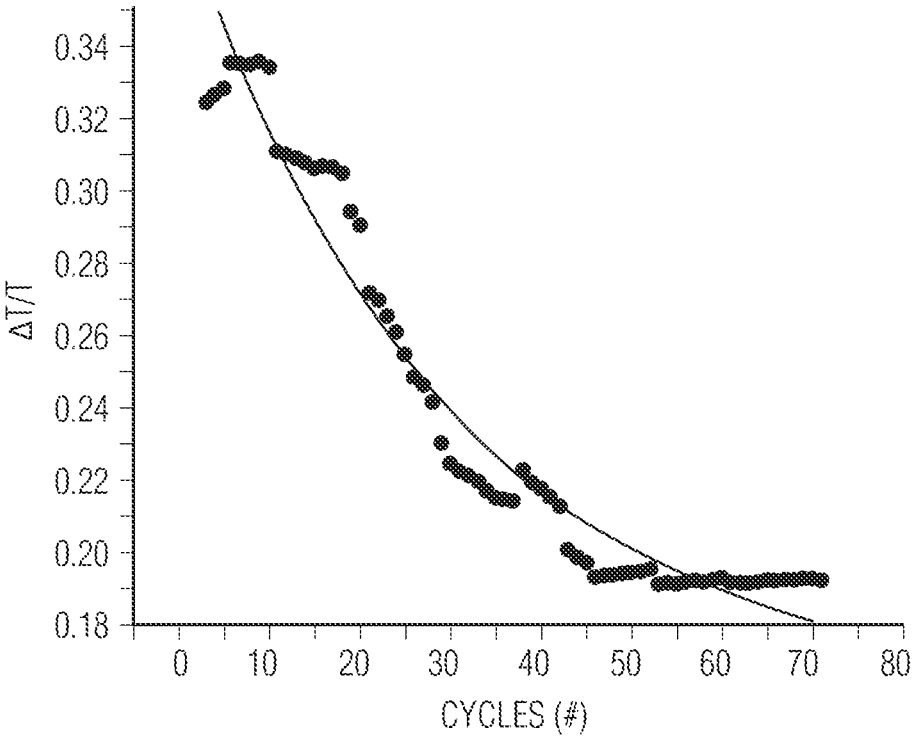
FIG. 9D illustrates a chart showing the change in undercooling with respect to the number of heating cycles, according to embodiments of the disclosure.
Figure 9E:
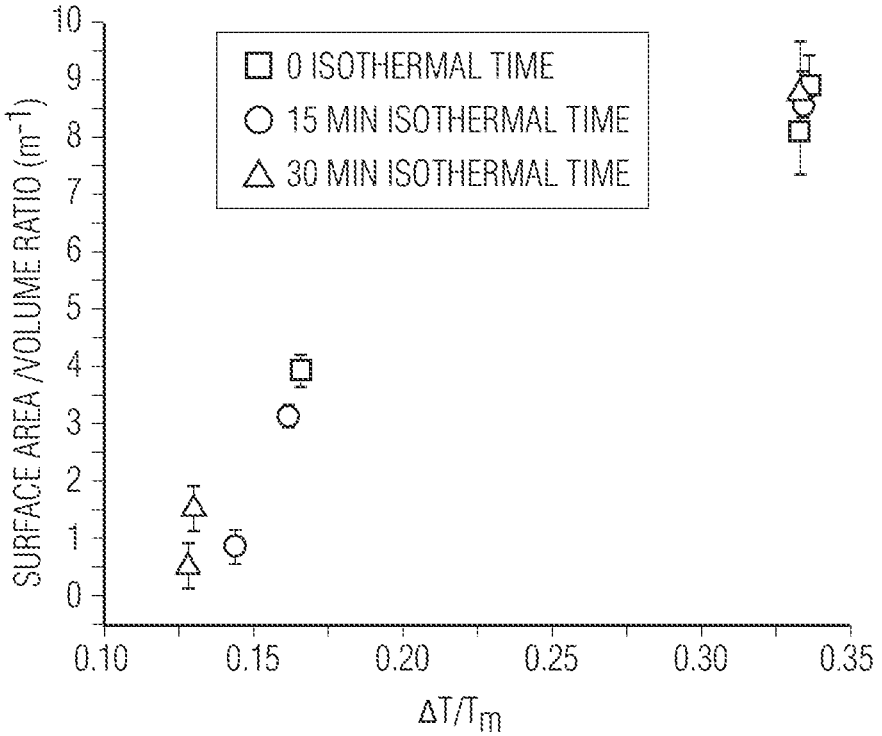
FIG. 9E illustrates a chart showing the change in surface area-to-volume ratio with respect to undercooling, according to embodiments of the disclosure.

To evaluate the stability of synthesized undercooled particles, accelerated and ambient aging experiments were performed on undercooled Fields metal particles. A sample (15 g) was stored in ethyl acetate under ambient conditions (bench top) for >2 years leading to a total loss of 43% undercooled particles in 8 months and to 57% over 2 years. FIG. 9D illustrates a chart showing the change in undercooling with respect to the number of heating cycles. FIG. 9E illustrates a chart showing the change in surface area-to-volume ratio with respect to undercooling. The ΔT/Tm changed from 0.34 to 0.14 over the two years but without loss in yield. The change in ΔT/Tm is likely due to the continued growth of the oxide shell and/or loss of the protective ligand. This data implies that the undercooled metal particles are stable against adventitious ambient perturbations over a prolonged time period. To further support this, a second sample was subjected to accelerated aging via weekly thermal cycling (200 K to 373 K) over the course of 70 cycles. For the accelerated aging sample, a significant change in ΔT/Tm is observed (FIG. 9E). The freezing point of these undercooled particles gradually increases but approaches an asymptote at ~273 K with an exponential decay trend (maximum Δ(ΔT/Tm)=0.15, FIG. 9E). Thermal-driven growth in the oxide shell, loss of surface ligands, and associated changes in surface morphology due to repeated expansion and contraction abet the decline in ΔT/Tm. When particles were heated to 473 K (where total loss of undercooling is observed), a gradual increase in particle size from the original ~1 μm was observed. This change also directly affects ΔT/Tm. Powder X-Ray Diffraction confirms changes in overall crystallinity with temperature. The amorphous undercooled material turns into a fully crystalline state after heating it to 473 K indicating solidification. This is further confirmed via coupled TGA-IR-MS where, loss of surface ligands is observed from 475 K to 573 K, followed by a gradual increase in mass with heightened oxidation and sintering.

Figure 10:
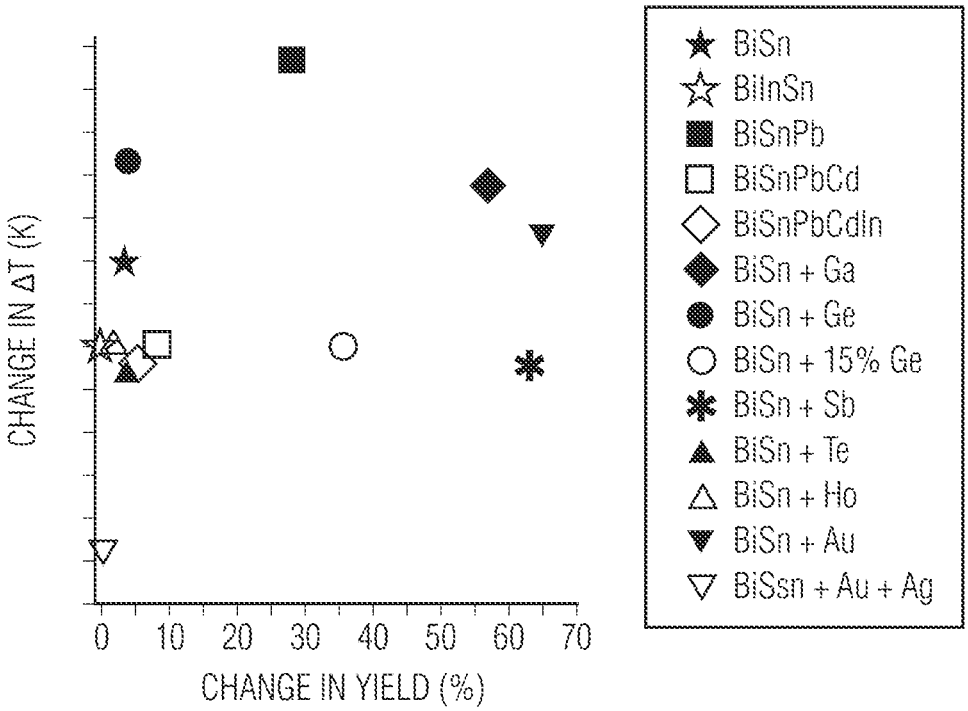
FIG. 10 shows a chart of the change in $\Delta T$ versus the change in yield for various alloys, according to embodiments of the disclosure.

The preservation of the organic layer can be an important factor in maintaining stability of these core-shell metal particles. The organic ligands may act as a physical barrier (limited physi and chemisorption) for the thin surface oxide shell. Changes in surface morphology were observed after repeated heating cycles, while a control sample (maintained at ambient) remained spherical and smooth. Surface imperfections can be a precursor to further oxide growth, which decreases interface chemical potential gradient per unit volume (Δμ tension) and ultimately ΔT/Tm. The slow oxygen diffusion process at lower temperatures justifies trend in changes in freezing point. The asymptote in ΔT/Tm (FIG. 9D) occurs when the oxide reaches a critical thickness, hence significantly slower oxygen diffusion occurs. From this study, the surface of the particles can play a role in the undercooling. Maintaining a smooth, ligand stabilized, surface can be an important factor for stable undercooling, however other factors can also play important roles. FIG. 10 shows a chart of the change in ΔT versus the change in yield for various alloys, however this chart is intended for example purposes only and any of the described alloys or other alloys may be suitable for making core-shell metal particles.

Interface Driven Undercooling of Various Alloys

From equation 1, interface-driven chemical potential changes can alter the dynamics of L-S phase transitions. To delineate the role of surfaces beyond the observed stabilization, the role of chemical properties of the dominant surface component was investigated. First, organic ligands of varying properties were investigated, both analogs of acetic acid and other (a total of 4) moieties with better binding to the passivating oxide (FIG. 11). To understand the effect of the surface oxide, varieties of lower and higher standard reduction potential ($E^0$) components were introduced to the BiSn base alloy.

Effect of the Oxide Shell and Interface Characteristics

Figure 12A:
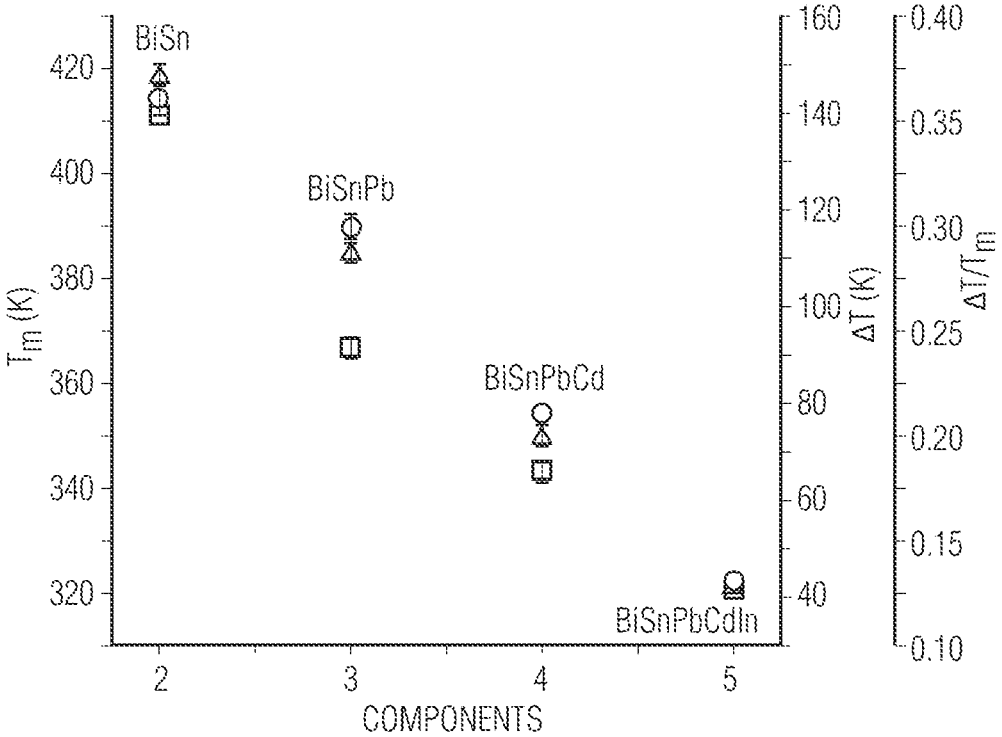
FIG. 12A shows a correlation between changes in components and under-cooling, according to embodiments of the disclosure.
Figure 12B:
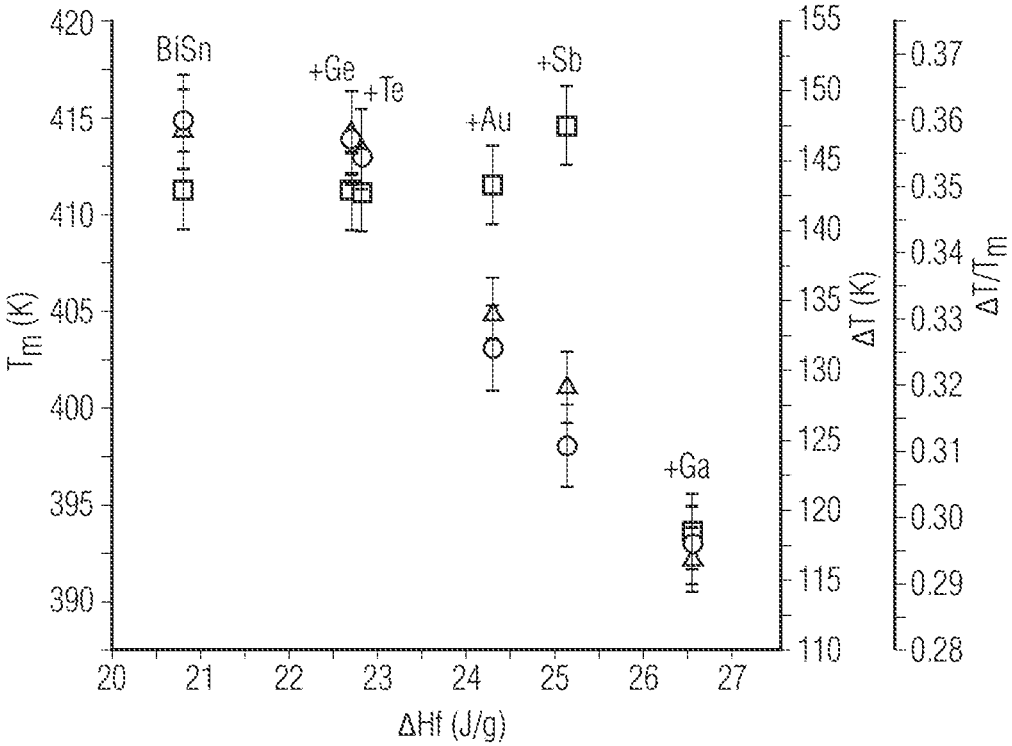
FIG. 12B shows a correlation between changes in enthalpy and under-cooling, according to embodiments of the disclosure.

FIG. 12A shows a correlation between changes in components and under-cooling and FIG. 12B shows a correlation between changes in enthalpy and under-cooling. More detail for each alloy is shown in table 1700 of FIG. 17. This data is described in more detail in publication titled, "Stabilization of Undercooled Metals via Passivating Oxide Layers" *Angew. Chem. Int. Ed.* 2021, 60, 5928-5935, and the associated supporting information titled, "Stabilization of Undercooled Metals via Passivating Oxide Layers published in Angewandte Chemie by Andrew Martin et. al, which are incorporated by reference herein in their entirety for all purposes. FIG. 13 shows a table describing changes in degree of undercooling and yield of BiSn-based alloys with different additives, forming eutectic (eut.) phase or simply adding small quantities (imp.).

Field's metal (eutectic BiInSn alloy) forms a predominantly indium oxide surface (lowest $E^0$) with significant undercooling (ΔT/Tm=0.34). To evaluate the role of oxide shell on undercooling, particles were prepared from eutectic BiSn (yield=89%, ΔT/Tm=0.36, FIGS. 12A and 13). The binary BiSn gave slightly higher ΔT/Tm as compared to ternary BiInSn, albeit at a slightly lower yield of undercooled particles. The effect of additives to the BiSn base alloy (either by forming 3, 4, or 5 component eutectic alloys or adding small 'impurity') were evaluated. First, to ascertain that change in yield is not a result of change in compositional entropy (based solely on number of components making up the alloy), other non-indium containing ternary alloys were evaluated. When In (in Field's metal) was substituted with Pb ($E^o$=−0.13V, Rose's metal, BiSnPb) quantitative yield (100%) was obtained albeit with a slight decrease in degree of undercooling T/Tm=0.30, FIG. 12B). Increasing compositional entropy to BiSnPbCd (Wood's metal, Cd $E^0$=−0.4V) led to a drop in both yield (95%) and undercooling T/Tm=0.21, FIG. 13). Re-introduction of In ($E^0$=−0.34V) to make BiSnPbCdIn alloy led to recovery of the quantitative yield (100%) but with a concomitant loss in undercooling T/Tm=0.13). Compilation of these data suggests that increasing compositional entropy does not always correlate with increase in metastability (FIG. 13). While the formed alloys typically result in higher yield, ΔT/Tm either stays constant or decreases with increase in components. Most of the added components forming these alloys have a lower $E^0$ compared to Sn ($E^0$=−0.14V) (dominant component in the oxide shell in BiSn particles). It is therefore likely that the addition of a lower $E^0$ component plays a role in reconstructing the surface architecture and altering undercooling behavior. To understand this better, a gallium ($E^0$=−0.51V) containing homologue (BiSnGa) was quantitatively undercooled (yield=73.4%, ΔT/Tm=0.29, FIG. 13). The addition of Ga alters both surface and bulk behavior due to strong Ga—Sn interactions, resulting in significant shift in thermal behavior (captured by large widening of solidification and melting peaks in the thermogram).

To ascertain the role of the dominant component (from an $E^0$ point of view) on the oxide shell, and hence the chemical potential gradient, small amounts (e.g., ≤1%) of "impurities" were introduced with higher or lower $E^0$ than Sn ($E^0$=−0.14V) into eutectic BiSn. FIG. 13 summarizes the results based on DSC traces from each sample of the undercooled alloys. Generally, the addition of higher $E^0$ impurities does not alter the dominant component in the oxide shell, albeit with perturbation in surface sub-oxides and bulk cohesive energy density. The latter when more favorable will lead to decrease in meta-stability due to a high propensity to form a critical nucleant. The addition of Ge ($E^0$=0.1V, 1%), led to similar ΔT/Tm with a slightly lower yield. Increasing the amount of Ge (~15%) leads to a decrease in ΔT/Tm. For lower $E^0$ impurities, likely an oxide shell is dominated by the additive. Adding a small amount of Sb ($E^0$=−0.51 V, 1%) and Te ($E^0$=−0.90 V, 1%) led to ΔT/Tm=0.31 (63% yield) and ΔT/Tm=0.35 (81% yield) respectively. Both additives result in a decrease in the degree of under-cooling and yield, which are expected in this system since they are both surface-altering.

Besides changes in surface oxide and cohesive energy density, formation of nucleant can be dependent on flux. Flux in viscous media or solids can be proportional to atomic radii. Addition of larger atoms such as Ho ($E^0$=−2.33 V) and Au ($E^0$=1.83 V) led to a relatively significant change in both ΔT/Tm (0.26 and 0.33) and yield (82.3% and 65.11% respectively). From these data, ΔT/Tm decreases with either changes in oxide shell structure or, changes in cohesive energy density. The particular preparation method may lead to a statistical enrichment of a minor component in a few particles altering the yield and degree of undercooling. Darken-Gurry and TC-YM plots show that solid solubility can be limited when the Pauling electronegativity difference is >0.4, even when atomic size is comparable.

Understanding Compositional Entropy

To evaluate the origin of the disparity in the yield and degree of undercooling, the correlation was evaluated between the number of components, ΔT, and ΔT/Tm for all prepared homologs of BiSn. It was observed that an increase in the number of components forming eutectic alloys generally led to a decrease in Tm and ΔT/Tm, however other additives may have different effects. Adding a relatively large amount of impurity (see Ge in FIG. 13) leads to a similar decline. It therefore follows that an increase in the number and quantity of components in the alloy may interfere with the ability to frustrate solidification which could be due to formation of intermetallic compounds with cooling. Increase in favorable interactions can be correlated with the enthalpy of the system. Therefore, although the compositional entropy increases, increase in cohesive energy density diminishes entropic advantages to frustrating solidification. Addition of Ga, for example, confirms this behavior. Although Ga would theoretically dominate the oxide, a strong interaction with Sn assists bulk relaxation. To confirm this inference, the correlation between ΔHf with transition points was evaluated. All three parameters (Tm, ΔT and ΔT/Tm) decrease with increasing enthalpy of fusion, albeit at dissimilar rates. Thus, alloys with stronger bulk interaction, may be challenging to undercool.

Figure 14A:
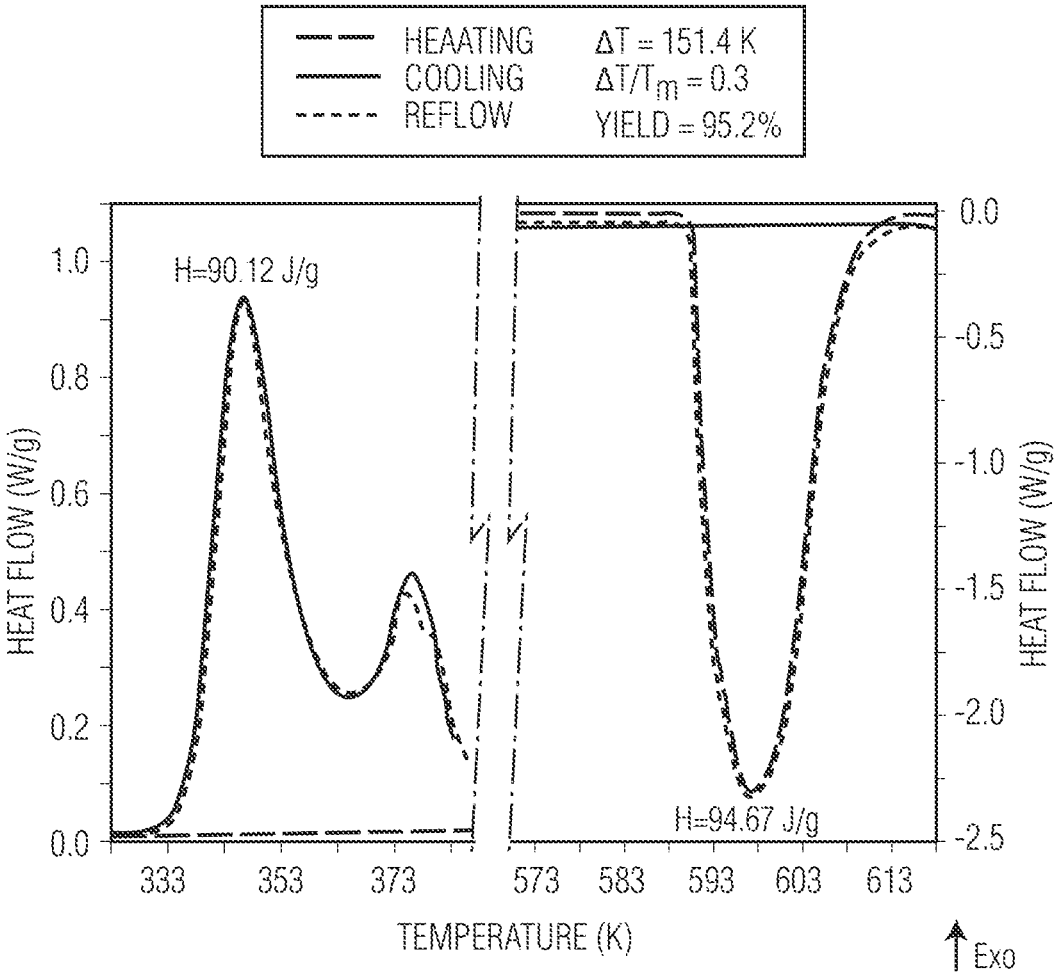
FIG. 14A shows a DSC trace of undercooled SAC305 particles, according to embodiments of the disclosure.
Figure 14B:
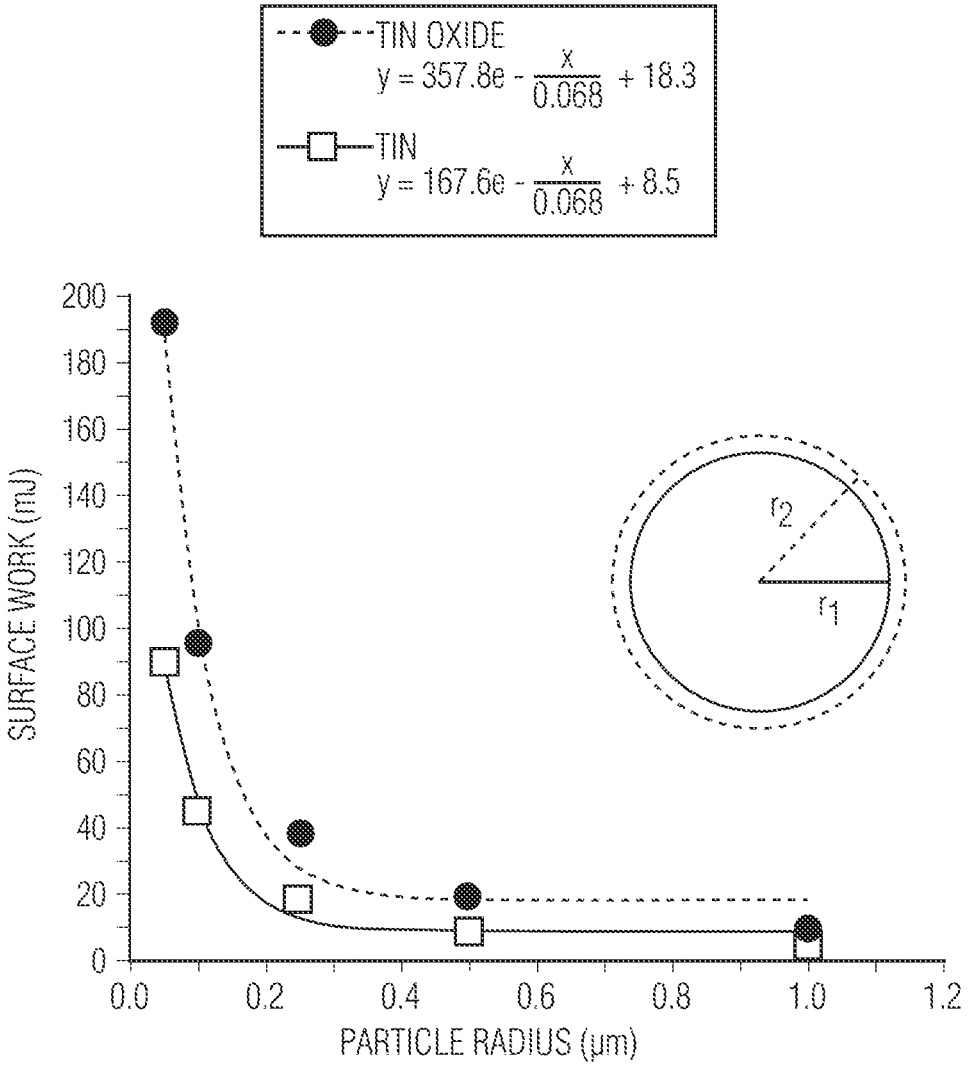
FIG. 14B shows the theoretical amount of surface work versus particle radius, according to embodiments of the disclosure.

FIG. 14A shows a DSC trace of undercooled SAC305 particles. FIG. 14B shows the theoretical amount of surface work versus particle radius. When correlated towards the solubility parameters, akin to Darken-Gurry plots, impurity elements with moderate size and $E^0$ differences tend to give the highest ΔT/Tm. To test this hypothesis, a 3-component alloy (SAC305 solder) was undercooled and which resulted in ΔT/Tm=0.3 (95.2% yield, FIG. 14B). SAC305 has a significantly higher ΔHf compared to any of the BiSn based alloys and thus, requires larger amount of surface work to achieve comparable degree of undercooling.

Predictive Analysis of Undercooling Behavior and Simplification

In some embodiments, based on the accumulated data on various alloys, maximum undercooling may be achievable within the 2-3 component alloys with moderate ΔHf. Correlation between average minimum undercooling and ΔHf from each additive indicates that a critical point at circa 3 component alloys. When ΔHf and number of components in the alloy are compared to ΔT/Tm an overall surface map is generated. From the trend of this plot, in some embodiments, a maxima is found in the window of 2-3 component alloys with moderate ΔHf. This signifies that enthalpy-entropy balance may be important in achieving high undercooling levels by tuning surface work. Based on equation 1 if the enthalpic and entropic contributions in the system are balanced, the two terms are eliminated leading to a simplified description of associated free energy as;

$$\Delta G_{LS} = \frac{\Delta H_f \Delta T}{T_m} - < \nabla \Gamma_i \mu_i > \tag{3}$$

Equation 3 indicates that, when ΔHf≈0, ΔG is dependent on surface work. Surface composition in liquid metal core-shell particles, therefore, indicate L-S phase transition. This simplified equation also suggests that alloys with high ΔHf, such as SAC305, may need more work to reach the same undercooling as BiSn. A theoretical amount of surface work can be enhanced based on curvature (increase in Laplace pressure jump) therefore, as expected, the degree of undercooling should increase with decrease in particle diameter. Since particle size distribution is tunable using SLICE, undercooling behavior of synthesized particles can be predicted.

This work demonstrates a neoteric way of frustrating L-S phase transitions by tuning interfacial surface tension of the metallic core-shell particles.

i. Undercooled particles can be stabilized using an organic core-shell architecture. Organic ligands limits chemi- and physi-sorption on the smooth passivating oxide improving stability. At ambient conditions, majority of the particles remain undercooled for >2 years of storage.

ii. Felicitous choice of alloying components enhances enthalpy-composition entropy balance, which may be important in maximizing surface work hence undercooling. Balancing miscibility and partition between surface and bulk enables tunable under-cooled and stability.

iv. Redefined solubility by introducing the preferential interaction parameter (PIP) that captures the adjusted miscibility due to surface reaction. This parameter besides predicting solubility, predicts surface speciation hence, the associated divergence in interface tension. It follows that favorable liquid miscibility with concomitant segregation of less miscible components to the surface predicates improved undercooling (metastability).

Experimental Methods

Bismuth Tin Alloying: Tin ingots were melted and then transferred into a crucible. The mass of the tin in the crucible was recorded as 42% of the total alloy weight and 58 weight percent bismuth shots were calculated based the mass of tin to achieve a eutectic composition. Other metals at different composition percentage were deposited into the molten tin pool and mixed until completely dissolved. Afterwards, bismuth shots were added into the mixture and mixed until completely dissolved.

BiSn Based Alloy Particle Synthesis: Various under-cooled metal particles having a bismuth tin base alloy were synthesized following methods. 1 gram trichloroacetic acid was mixed into 200 ml of diethylene glycol in a beaker. Metal pellets of ~5 g weight were added into the solution and heated up while stirring on a hot plate up to 433 K. A high speed rotating blade was used for the shearing process, variable heating tape was wrapped around the apparatus and the apparatus was sealed using an aramid blanket to limit heat dissipation during the shearing process. Diethylene glycol solution was transferred into the apparatus and then sheared for 4 minutes at ~27,000 rpm with the shearing blade elevated on one side to create a ~10° angle. Once finished, the solution was extracted and washed using ethanol and ethyl acetate whilst cooling down in ambient condition. The solution was filtered using a Buchner filter with Whatman GF/F paper filter. Filtered particles were washed, harvested and stored in ethyl acetate.

SAC 305 Particle Synthesis: 0.5 ml paraffin oil, 0.2 g trichloroacetic acid, 0.2 g poly(acrylic acid) and 0.5 g of SAC 305 alloy was placed in a ~5 ml beaker heated up on an oil bath. The solution was heated up to 533 K and maintained at that temperature to keep the metal in a liquid form. A rotating blade was used to shear the particles at 27,000 rpm for 6 minutes. Particles were then extracted and quenched in ethanol bath, then cooled down to room temperature. Once at room temperature, particles were decanted and washed using ethyl acetate to remove trace oil content.

Differential Scanning calorimetry (DSC) Analysis: In order to measure the level of under-cooling, a DSC (Model Q2000, TA Instruments) fitted with a liquid nitrogen cooling unit was employed. The particles stored in the ethyl acetate solution were transferred to an aluminum pan and the ethyl acetate content was evaporated at ambient conditions before the sample was hermetically sealed with an aluminum lid. The sample was heated from a standby temperature of 313 K up to 573 K (varies with different alloys) with a heating rate of 10 K/min, then cooled down to 203 K with the same rate. Several alloys were cycled through the heating and cooling cycles to show reflow and recyclability behavior. Data analysis was performed using TA TRIOS software.

Scanning Electron Microscopy (SEM) Characterization: Metal particles stored in ethyl acetate solution were transferred onto silicon wafer using pipettes and then were characterized by Scanning Electron Microscopy (FEI Quanta 250 FEI-SEM). Samples were mounted on standard SEM mount (Ted Pella Inc.) adhered with copper tape. The SEM was operated under high vacuum at a voltage of 10-15 kV with spot size of 3 at 10 mm working distance. An Everhart-Thorley secondary electron detector and backscatter detector were used to take micrographs at various magnifications.

High Angle Annular Dark Field Scanning Transmission Electron Microscopy (HAADF-STEM) Characterization: Synthesized metal particles were drop casted onto a copper TEM grid (Ted Pella Inc.) and mounted onto a double tilt TEM sample holder. An aberration corrected FEI Titan Themis 300 with probe correction TEM operating at 200 kV was used to acquire images. EDS analysis was performed on the same instrument using the Super-X EDX Detector. Oxide shell thickness approximation was done using the "Find edges" function in in the J. Sobel filter which allowed for pixel contrast intensity calculation along a drawn line where higher intensity corresponds to brighter color (white) and drops in intensity corresponds to the oxide layer (black).

Thermogravimetric Analysis (TGA)-Infrared (IR)-Mass Spectrometry (MS) Analysis: A coupled TGA-IR-MS instrument (Netzsch STA449F1) was used to analyze mass change and evolved gas released during the particle's heat treatment. Samples were deposited and dried in an alumina crucible with a matching reference crucible. Simulated dry air (80% oxygen 20% nitrogen) was used as a purge gas. The sample was then loaded and ran through a heating ramp step at 10° C./min. The acquired data was analyzed using Proteus and Opus software.

Free Energy and Symmetry

Gibbs free energy (G) is a thermodynamic potential that can be used as a tool for determining whether an occurring event is favorable given constant temperature and pressure. A thermodynamic system will undergo favorable transition if the change of G ($\Delta G$) from one state to the other results in a lower energy state (i.e. $\Delta G<0$). Major component of Gibbs free energy equation involves a balance between enthalpy (H) and entropy (S), which reads as follows: $G=H-TS$. Enthalpy is a state function that houses the internal energy and PV work in the system ($H=U+PV$), where U is the internal energy of a system that can be further extended as $U=TdS-PdV+\delta w'$ ($\delta'$ being non-pv or non-mechanical work on the system). If the G term is expanded into the more common derivative form, we end up with the familiar, $\Delta G=\Delta H-T\Delta S+\delta w'$. In some calculations, $\delta w'$ is neglected by assuming there is no non-pv work done on the system. The equation will then turn to a competition between whether a process will be enthalpy dominated (increasing order) or entropy dominated (increasing symmetry), which can be pictured, for example, by the process of solidification (low temperature, ordering of atoms, exothermic, enthalpy dominated) or melting (high temperature, disordering of atoms, endothermic, entropy dominated) respectively.

Landau's theory of phase transition expresses thermodynamic potential as a function of order parameter ($\theta$) which gives a whole new perspective into the event of phase transition. In Landau's theory, an ordering event will result in $\theta$ approaching 0, where nearest neighbor interaction forces order into one direction and thus U dominates (same principal as an enthalpy dominated event or solidification, although the ordering in this case is addressing magnetic order, M). On the opposite end, disorder or large entropy will result in $\theta$ approaching 1. Extending upon Landau, Ising's theory gives a better quantification parameter for the balance between order in symmetry in the form of J-exchange constant (a parameter that deals directly with nearest neighbor interaction), coordination number (q) and Boltzmann constant ($K_B$). In Ising's theory, the order-symmetry balance reaches a critical point at $$\frac{Jq}{K_B T} = 1 \text{ or } Jq = K_B T.$$

This can be thought of as the balance between enthalpy and entropy, once again relaying back to Gibbs free energy.

The correlation between the thermodynamic potentials as postulated by Gibbs, Landau and Ising provides a tool to control phase transition, specifically the liquid-solid phase transition that is important for undercooling.

Nucleation

Undercooling is a process that happens within the liquid-solid transition window, also known as solidification or nucleation. Solidification is an event that is initiated from nucleation that happens due to energy minimization of a system, to which it is favorable when the free energy difference between liquid and solid state is negative ($\Delta G_{ls}<0$). Different free energy terms can be used to explain this phenomenon, however, Gibbs free energy ($\Delta G$) which assumes constant temperature and pressure can be used to explain this event. Multiple nucleation initiation mechanisms exist which can be categorized into two major classifications, homogeneous and heterogeneous. Homogeneous nucleation can be described by, $$\Delta G=4/3\pi r^3\Delta g+4\pi r^2\gamma \quad (4)$$

Where $\Delta G$ corresponds to the free energy of a particle/droplet. The $\Delta G$ is a governed by volumetric and interfacial terms based on the radius (r), volumetric free energy ($\Delta g$) and interfacial energy ($\gamma$). Due to the proportion of these volumetric and interfacial terms, there is division where the interfacial term dominates (low r) and where the volumetric term dominates (high r). At a certain radius, the transition point between these two regions is indicated by a maxima that is marked as the nuclei critical size (r*). The activation energy to reach this critical size is defined by, $\Delta G^*=16\pi\gamma^3/3\Delta g^2$ which can be used to define the initiation of the solidification process. Thus, achieving a high activation energy can be utilized to reach high undercooling.

The definition of homogeneous nucleation is mainly governed by intrinsic process and properties. Heterogeneous nucleation, on the other hand is an extrinsic process dependent on nucleation seeds present within the boundaries of the system. The formation of heterogeneous nucleants can be explained by using the interfacial tension balance equation, $$\gamma_{ls}=\gamma_{sv}+\gamma_{lv}\cos\theta \quad (5)$$

Where $\gamma_{ls}$, $\gamma_{sv}$ and $\gamma_{lv}$ are the liquid-solid, solid-vapor and liquid-vapor interfacial tension respectively and $\theta$ is the wetting angle. Given this relationship, the volume of which a heterogeneous nucleant reaches r* is much smaller to that of a homogeneous nucleation and is dependent on the wetting angle. The ratio of the volume reduction can be explained by the expression: $f(\theta)=\frac{1}{4}(2-3\cos\theta+\cos^3\theta)$. Where now $f(\theta)$ is the ratio between critical heterogeneous and homogeneous nucleation energy ($\Delta G_{het}^*=\Delta G_{hom}^*f(\theta)$). Multiple heterogeneous nucleation modes exists, and from this relationship it can be seen that the critical energy for heterogeneous nucleation is lower than homogeneous nucleation. Because of this, heterogeneous nucleation can be eliminated by using a container-less approach in various undercooling studies thus removing any surface contacts. Another approach to this is by achieving complete non-wetting. Preventing both nucleation modes by introducing a high activation energy barrier ultimately leads to a high degree undercooling in metallic systems.

Undercooling Thermodynamics

Free energy of a thermodynamic system under constant temperature and pressure can be defined by Gibbs free energy, which is commonly expressed as $\Delta G=\Delta H-T\Delta S$. Where H and S are the enthalpy and entropy of the system respectively. Free energy of a system depends on the balance of these two terms and phase transition can be driven by either enthalpic or entropic forces. A process is deemed favorable when $\Delta G<0$ and thus for the case of undercooling (liquid-solid transition) $G_S-G_L<0$. The free energy term can be derived further as a term of specific heat ($C_p$), where $\Delta H=\Delta H_f-\int_T^{T_m}\Delta C_p dT$, $$\Delta S = \Delta S_f - \int_T^{T_m} \frac{\Delta C_p}{T} dT$$

and $\Delta H_f=T\Delta S_f$. This in turn gives the relationship shown as equation 1 in the main text, $$\Delta G_{LS} = \frac{\Delta H_f \Delta T}{T_m} - \int_T^{T_m} \Delta C_p(T)dT + T\int_T^{T_m} \frac{\Delta C_p(T)}{T} dT \quad (6)$$

Where $\Delta Hf$ is the enthalpy of fusion, $T_m$ is the melting temperature and $\Delta T$ is the temperature difference between melting and freezing point, the term $\Delta T/T_m$ is used to determine the degree of undercooling in the system. Various studies have been performed to evaluate the increase in $C_p$ under different assumptions which will lead to increase in $\Delta G$. This change ultimately increases the degree of undercooling. Some models introduce what is known as maximum undercooling limit. The study of liquid-solid transition focuses on enthalpic and entropic terms (PV based), often neglecting the existence of interfacial and surface terms that were previously discussed in nucleation theory due to it often having a minor or negligible effect on the whole system. However, surface terms can dominate the bulk given different processing conditions that forces high interfacial tension towards the bulk.

Figure 15:
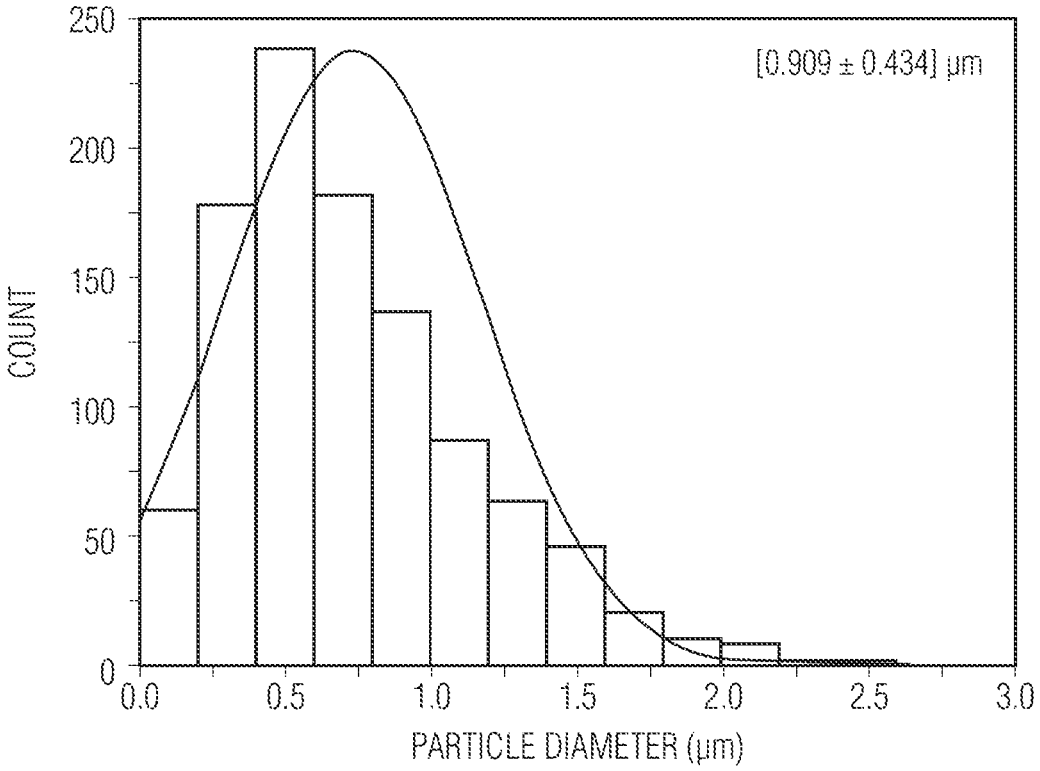
FIG. 15 shows the particle size distribution of as-synthesized particles, according to embodiments of the disclosure.

FIG. 15 shows the particle size distribution of as-synthesized particles which in this embodiment range between 0.1 to 1.5 microns, however other embodiments may have different ranges of particle sizes.

Undercooling of Various BiSn Based Alloys

FIG. 16 shows a table including constants of elements used in some embodiments. FIG. 17 shows a table 1700 tabulating the undercooling level and yield, before and after reflow, for various alloys according to some embodiments of the disclosure. AT was calculated by subtracting $T_f$ from $T_m$. Yield was calculated by taking the ratio of the area under the melting and freezing curves.

$$\text{Yield} = \frac{H_{freeze} - H_{melt}}{H_{freeze}} \quad (7)$$

Calculations for $\Delta T$ and Yield were performed on as synthesized samples and on reflowed samples. True yield was reported from reflowed samples as the reflow process removes any solidus content that emerges during the synthesis process.

Influence of Organic Ligands

Comparison of $\Delta T/T_m$ when the inductive properties of the organic shell are diametrically opposite shows that the inferred surface chemical potential gradient across changes under positive or negative inductive surface moieties. This can be due to inductive effects or due to the nature of ligand-oxide bond when the electron density across the binding moieties is perturbed. Introducing this inductive effect into SAC305 particle synthesis, the $\Delta T/T_m$ of these particles can be enhanced from 0.21 to 0.3, pushing the freezing point to <100° C. Stabilization of these particles due to the presence of organic ligands were also confirmed as these particles were able to withstand multiple heat cycles without experiencing major shift in undercooling.

FIG. 17 illustrates tabulated data showing the effects of different ligands for BiSn particle synthesis. The influence of organic ligands used to synthesize the core-shell particles are investigated by using various acids, thus altering the inductive effect due to changes in electronegative properties from said ligands. The most common experiments done on this work is done using trichloroacetic acid, which is highly electron withdrawing (i.e. high electronegativity). This behavior induces a negative inductive effect on the surface of which these ligands attach to, creating electronic tension (negative dipole moment) on the interface. When an acid with opposite electronegative behavior is used (e.g., phosphotungstic acid), a positive inductive effect is applied, and thus electronic compression is created. Both negative and positive inductive effects can produce high degree of undercooling (e.g., >0.34), although with varying yield.

Investigating the effect of inductive effect, ligands with lower electronegativity is used (tribromoacetic and chloroacetic acid). Both acids used results in lower degree of undercooling and lower yield. This result further suggests that the effect of a surface inductive effect from the organic shell itself plays a role in driving undercooling behavior on the core-shell particles.

Liquid Metal Surface Oxides

This portion of the disclosure describes opportunities in the passivating oxide of liquid metal particles. Subsurface complexity and order present an opportunity to frustrate homogeneous nucleation and enable enhanced undercooling. Plasticity of the underlying liquid metal surface present an autonomously repairing subsurface hence the lowest $E^o$ component dominates the surface unless it is stoichiometrically limited. This plasticity provides an opportunity to synthesize organometallic polymers that in situ self-assemble to high aspect ratio nanomaterials. Induced surface speciation implies that under the appropriate oxidant tension, the oxide thickness and composition can be tuned leading to temperature-dependent composition inversion and so-called chameleon metals.

Figure 18:
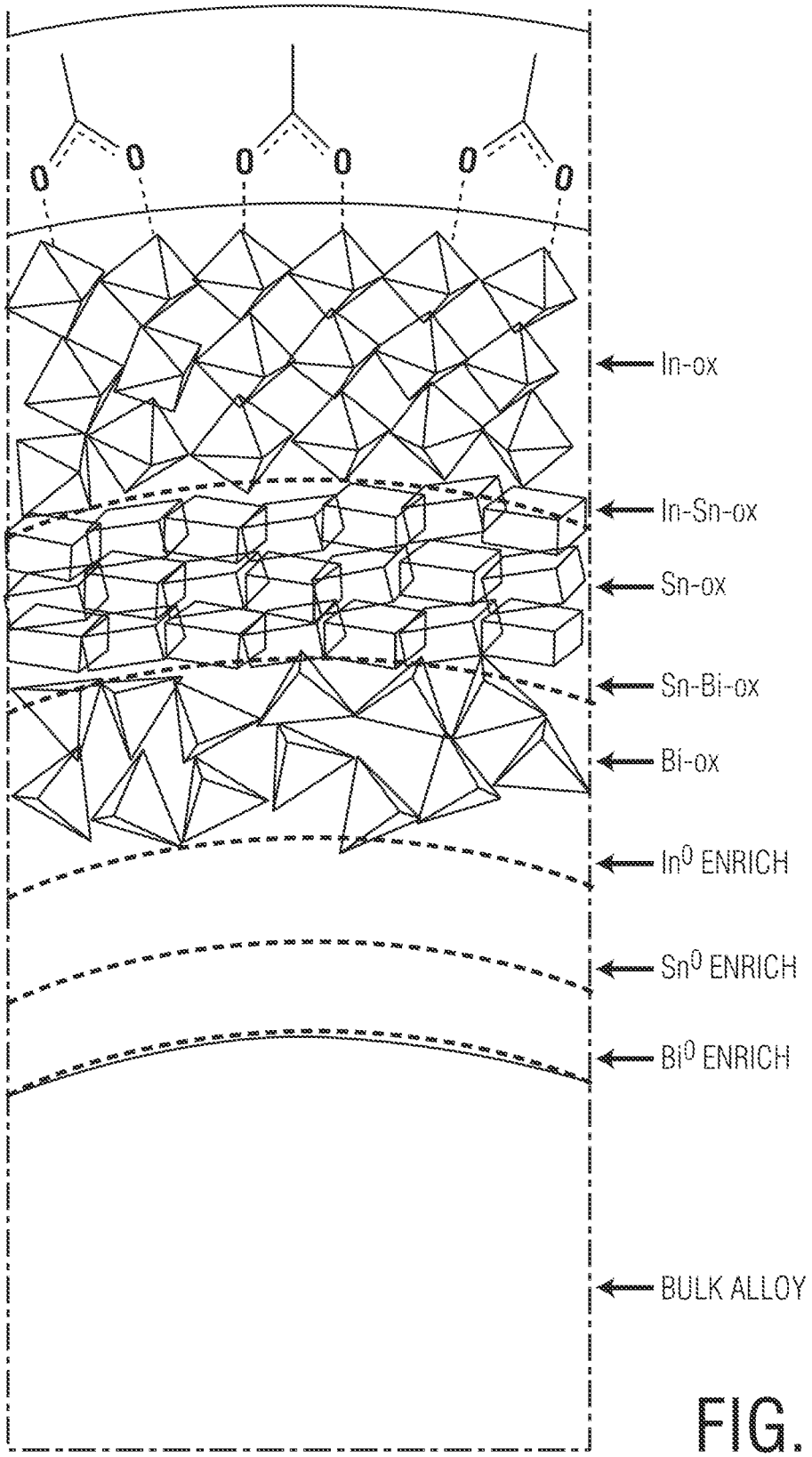
FIG. 18 is an expanded view of a hypothetical surface oxide architecture for Field's metal, according to embodiments of the disclosure.

FIG. 18 is an expanded view of a hypothetical surface oxide architecture for Field's metal. In this case it is assumed that the surface has no mass and no volume (e.g., Gibbs Dividing plane, GDP). In other cases, a surface constitutes a continuum of the bulk only differing by the number density of components) occupying such a region (Gibbs-Duhem Interface, GDI). Thermodynamically, surfaces can include the mass, and energy, dissipation boundary horizons of any system. Thus, defining a surface solely on mass distribution can be insufficient. Considering energy distribution, GDP necessitates a duality, in that, transition from one phase to the other will constitute a point in space where two values of energy are feasible, and there is an instantaneous jump in energy. This scenario negates any semblance of equilibria hence, may be unlikely. The GDI on the other hand, with a declining concentration gradient can describe low or high cohesive energy density (vapor pressure) material systems. In crystalline materials one can argue that the lattice planes are clearly define hence a GDP is appropriate in such scenario. Considering a flat crystalline metallic system (pressure jump=0, vapor pressure≈0), and considering nature of a metallic bond, then a 'sea of electrons' should occupy the surface. Considering the dual nature of electrons, and the uncertainty principle, defining the loci of the surface negates the flux (speed) of the surface electron, and vice versa. Assuming an energy gradient (GDI) near the surface of an equilibrating mixed material, then autonomous speciation is likely as has been driven by curvature in the Lowengrub-Voigt model or in thermo-oxidative composition inversion.

In some embodiments the following governing rules drive the speciation. For reacting components, preferential formation of a bond may lead to order and organization over relatively short distances (1-2 nm) as in hydrocarbon self-assembled monolayers. In more stochastic systems, like formation of passivating oxides on metal alloys, redox-driven differentiation can occur over several nanometers. It therefore follows that, the surface of a material can be a complex part due to its size (nm) energy profile composition, structure, and reactivity.

Liquid Metal Particle:

Most metals rapidly oxidize in air to form a thin layer of oxide. It can be stated that the thin passivating oxide layer makes up the particle surface, but an oxide is not a metal so thermodynamically it is a different component. To define a surface, in this respect, is to look for a set of components that are not part of the object in consideration. Though dissimilar, the passivating oxide and the energetically dissimilar interface metal layer constitutes the surface.

The passivating oxide may not be similar to self-assembled monolayer (SAM) on coinage metals where the organic and the metal are clearly different entities. Unlike the monolayer system that has a definitive linkage point, for example in the Au—S bond the passivating oxide is a dynamic continuum, emergent from the bulk and a result of an equilibrating system. This relationship would lead to the tensorial nature of the surface tension as opposed to the scalar nature for SAMs. The governing rules for its establishment can be dependent on the environment (temperature, reactive species, pressure etc.), the reactivity of components of the alloy, cohesive energy density (how well the alloy components like each other), diffusivity (hence atomic radius), and thermodynamic state of the bulk. The high vapor pressure of both the metal and the oxide can preclude possibilities for a gradient in concentration which in turn imposes a duality in energy at the metal-oxide interface suggesting existence of an energy jump across a plane (GDP). It follows that there may be some gradient in composition or energy states as the metal-oxide layer is approached from the oxide or the metal side of the interface. The surface, irrespective of the definition adopted, is therefore a metastable region of the material whose energy state can only be averaged from the divergence of the energy states across each point in the surface. At ambient, a diffuse layer of speciated surface material ($\sigma$) mirrors an energy gradient between the system and its surrounding, and this gradient may be dynamic and susceptible to small perturbations. Based on the standard reduction potential of the underlying components, their propensity to flux, and interaction with other alloy component, an equilibrium state is established. FIG. 19 illustrates this behavior for BiInSn (Field's metal). Understanding this surface, therefore, depends on observation length scale, time, and its complexity among other properties. Passivating oxides are typically larger than most SAMs (e.g. oxide of eutectic gallium indium 2 nm, while a decanethiol SAM 1 nm).

Analogy

SAMs are one particular example of a thin (nanometer) layer on metal surfaces that significantly alters the properties of the material including the work function, tribology/wettability, conductivity and plasmonic activity among others. The SAM can be formed via a thermodynamic driven self-assembly process, resulting in a very ordered structure. The deposited thin layer of material offers great opportunities in more fundamental areas, most notably structure-property relationship and interfacial phenomena. The SAM system can be modeled as two interfaces surrounding the bulk (often a hydrocarbon), where each of these three components can be investigated separately by tuning the basic building block, the molecule. Because of the small size of the molecule and the dependence on molecular orientations, any minor changes in the surface can alter the entire system. Under well-controlled conditions, however, the SAM can be analyzed. The application of SAM can be divided into 2 types, some applications directly utilize the structure-property relationship of SAM molecule. For example, the monomolecular nature of SAM leads to their uses in the molecular electronic as well as a candidate in tunable hydrophobic coating. On the other hand, the highly tunable nature of SAM makes it a great candidate platform for building/anchoring other components on metal surfaces.

Studies on the passivating oxide layer of liquid metal particles have been very limited, in part due to challenges in characterization techniques. This difficulty comes primarily from the compositional complexity within the underlying metal oxide interface over a very small distance. This passivating oxide layer, however, when properly formed and/or engineered provides various advantages to a material. In non-reacting liquid droplets, curved surfaces of micro- to nano-sized particles bear a sharp energy and compositional gradient, that are largely captured through the interfacial excess, Γi and the Laplace pressure jump condition ($\Delta P=2\gamma/r$, Where $\gamma$ is the surface tension and r is the radius of the particle). By definition, this sharp gradient serves the purpose of establishing both energy and mechanical equilibria between the particle and the surroundings. For metallic droplets, however, exposure to ambient conditions leads to rapid formation of a passivating oxide layer. In metallic alloys, differences in redox potential and diffusivity implies that at time, t=0 of exposure to air, a competitive oxidation ensues leading to the lowest standard reduction potential ($E^0$), with the most abundant and most diffusive component dominating the surface of the formed oxide. With time, however, a kinetically resolved self-sorting and speciation occurs often resulting in presentation of a unary metal oxide on the surface of metal alloys. This sorting/organization is dominated by, but not limited to $E^0$, stoichiometry, atomic size, cohesive energy density, atomic flux, oxidant diffusivity, temperature and pressure. Upon reaching a certain thickness, oxidation becomes infinitely slow and equilibrium is established.

In an oxidizing environment, all elements within an alloy have an equal probability to oxidize at t=0. This is only perturbed by their stoichiometry and propensity to occupy the surface. Kinetically, this becomes a race with the most 'favorable' element dominating the exterior surface of the oxide layer. In EGaIn this element is gallium. Over time, the oxide is reaching d_c^p, as oxidant flux slowly diminishes, leading to formation of underlying sub-oxides, derived from the less reactive components that were kinetically limited to fully oxidize. For a eutectic, selective depletion of some of the alloy components creates an energetically unfavorable hypoeutectic, which leads to enrichment of unreacted components at the metal oxide interface that mirrors that across the oxide shell. Sharp compositional gradients, however, present an interface with a large chemical potential gradient ($\Delta\mu$), hence a metastable surface. The $\Delta\mu$ coupled to $\Delta P$, presents a divergence in a stress that is proportional to the size of the particle. Such a gradient affects the properties of the particle.

Based on asymmetric energy distribution across the surface oxide, it may be possible to perturb bulk energy dissipation and induce relaxation by tuning surface stresses. Considering that molten metals have high symmetry (i.e. no order as defined in Landau's phase transformation theory) formation of passivating oxides, and the underlying enrichment to maintain equilibrium (e.g. eutectic composition), should introduce some pressure on free diffusion. Growth of a nucleant should overcome surface tension. Even after a nucleant seed forms, a competition between growth (reduction of bulk energy) vs shrinkage (increase in surface energy) ensues with the process getting biased to the former with increase in size. It can be stated that the magnitude of the nucleation rate is sensitive to the value of the interfacial energy, variations in σls (solid-liquid interface free energy) of only a small percentage can alter the predicted rate by several orders of magnitude. It may also be stated that a second non-dynamic solid-liquid interface, and associated order and free energy diversion, exists underneath the passivating oxide layer leading to two solid-liquid interface free energy perturbations that have to be overcome for successful nucleation growth—that is, the nucleant interface and the oxide interface.

Unlike the dynamic nucleant seed interface where shrinkage of the nucleant is overcome with growth, the structure of the passivating oxide is fixed and cannot be perturbed through growth. It therefore follows that, by engineering the surface oxide vis-à-vis miscibility of the bulk (liquid) components, one can significantly influence the growth of a nucleant, especially in a small (<10 μm) particle. The passivating oxide, therefore, should lead to significant frustration of liquid-solid phase transformation, hence enhanced undercooling. Previously, undercooling has been achieved by removing heterogeneous nucleant(s) through, for example, the containerless approach. Containerless approach, however, does not remove homogeneous nucleant(s)—a process that results from structural fluctuations in a liquid, and as such does not exploit the non-dynamic surface oxide interface tension.

The smaller the particle, the higher the likelihood of undercooling. This size effect is due to the large surface area-to-volume ratio that limits homogeneous nucleation. Considering that Gibbs free energy ($\Delta G$) is expressed as; $\Delta G=\Delta H-T\Delta S+\delta w'$, (here $\Delta H$ and $\Delta S$ is the change in enthalpy and entropy respectively, T=temperature and $\delta w'$=non-PV work) under the right enthalpy-entropy compensation conditions, surface work ($\delta'$) can dominate $\Delta G$. Whilst the aforementioned methods rely heavily in tipping the bulk enthalpy-entropy balance to manipulate phase transition, $\delta w'$ and surface contribution is often assumed to be negligible due to entropic limitations. But by definition, curved surface, are metastable hence a source of free energy stress that can alter the energy landscape of the whole material. Thus, engineering the surface oxide can lead to extension of these size-dependent (surface area-to-volume ratio) beyond the nano-into the micro-scale.

The surface work term captures the amount of energy needed to maintain the surface per unit area, $\delta w'=\gamma dA$. Surface tension, by definition is the product of interfacial excess and chemical potential difference, $d\gamma=\Sigma_{i=1}^{n}\Gamma_i d\mu_i$. The complex composition gradient demonstrated above creates a large curvature-dependent $\Delta\mu$ gradient hence, in small particles with large surface areas, the amount of $\delta w'$ can overcome the enthalpy-entropy balance and frustrate the liquid-solid phase transition ($\Delta GLS>0$) even when these perturbations are small. The structural complexity of the oxide, where properly tuned, can be sufficient as demonstrated by the long term stability of such prepared particles.

Besides the effect on free energy, formation of a uniformly smooth passivating oxide layer forms a physical barrier to heterogeneous nucleant(s), hence enhances stability of the undercooled state. This understanding enabled synthesis of stable undercooled liquid metal core-shell (ULMCS) particles enabling heat-free solders and a plethora of other ambient or low-temperature metal processing. Since the surface is the main driving force of the metastability, fracture of the oxide shell leads to instantaneous flow, coalescence, and solidification. Recent development allowed undercooling of commercially available lead-free solders, SAC 305, enabling low-temperature surface mount and electronic packaging. This low temperature sintering has enabled integration of conductive traces or circuits on otherwise temperature sensitive substrates (i.e. organics and polymers). Understanding the surface oxide presents a Braess-type paradox. Surface speciation may induce an inverse organization on the liquid metal.

Although droplet 100 (see FIG. 1) is described and illustrated as one particular composition and construction, embodiments of the disclosure are suitable for use with a multiplicity of compositions and constructions. Any elements and combination thereof can be used for the core and the shell. The shell can have any number of layers that are inorganic and/or organic.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

Terms "and," "or," and "an/or," as used herein, may include a variety of meanings that also is expected to depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein may be used to describe any feature, structure, or characteristic in the singular or may be used to describe some combination of features, structures, or characteristics. However, it should be noted that this is merely an illustrative example and claimed subject matter is not limited to this example. Furthermore, the term "at least one of" if used to associate a list, such as A, B, or C, can be interpreted to mean any combination of A, B, and/or C, such as A, B, C, AB, AC, BC, AA, AAB, ABC, AABBCCC, etc.

Reference throughout this specification to "one example," "an example," "certain examples," or "exemplary implementation" means that a particular feature, structure, or characteristic described in connection with the feature and/or example may be included in at least one feature and/or example of claimed subject matter. Thus, the appearances of the phrase "in one example," "an example," "in certain examples," "in certain implementations," or other like phrases in various places throughout this specification are not necessarily all referring to the same feature, example, and/or limitation. Furthermore, the particular features, structures, or characteristics may be combined in one or more examples and/or features.

In some implementations, operations or processing may involve physical manipulation of physical quantities. Typically, although not necessarily, such quantities may take the form of electrical or magnetic signals capable of being stored, transferred, combined, compared, or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining," or the like refer to actions or processes of a specific apparatus, such as a special purpose computer, special purpose computing apparatus or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

In the preceding detailed description, numerous specific details have been set forth to provide a thorough understanding of claimed subject matter. However, it will be understood by those skilled in the art that claimed subject matter may be practiced without these specific details. In other instances, methods and apparatuses that would be known by one of ordinary skill have not been described in detail so as not to obscure claimed subject matter. Therefore, it is intended that claimed subject matter not be limited to the particular examples disclosed, but that such claimed subject matter may also include all aspects falling within the scope of appended claims, and equivalents thereof.

What is claimed is:

1. A droplet comprising:

a core including an alloy comprising a majority of a first metallic element and a minority of a second element, wherein the core is in a liquid state below a solidus temperature of the alloy; and a shell fully enclosing the core and including an exterior surface comprising a majority of the second element and a minority of the first metallic element, wherein the shell is in a solid state below the solidus temperature of the alloy.

2. The droplet of claim 1 wherein the second element is a metal.

3. The droplet of claim 1 wherein the second element is a metalloid.

4. The droplet of claim 1 wherein the shell includes an innermost layer having a predominant concentration of the first metallic element and an outermost layer having a predominant concentration of the second element.

5. The droplet of claim 4 wherein the innermost layer has a greater $E^0$ than the outermost layer.

6. The droplet of claim 4 wherein the innermost layer has a lower $E^0$ than the outermost layer.

7. The droplet of claim 4 wherein the innermost layer and the outermost layer comprise oxides of the first metallic element and oxides of the second element.

8. The droplet of claim 1 further comprising a ligand coating on the exterior surface.

9. A method of forming a droplet, the method comprising:

forming a liquid core of the droplet from an alloy including a first element, a second element and a third element;

forming a solid shell around and fully enclosing the liquid core, the solid shell comprising an innermost layer having a predominant concentration of one of the first, the second or the third elements and an outermost layer having a predominant concentration of a different one of the first, the second or the third elements; and cooling the liquid core and the solid shell below a solidus temperature of the alloy while maintaining the core in a liquid state.

10. The method of claim 9 wherein the solid shell includes three layers, and wherein the innermost layer has a predominant concentration of the first element, an intermediate layer has a predominant concentration of the second element and the outermost layer has a predominant concentration of the third element.

11. The method of claim 10 wherein the shell is formed in an oxidizing environment.

12. The method of claim 11 wherein the oxidizing environment is controlled by changing a partial pressure of oxygen in the oxidizing environment.

13. The method of claim 11 wherein the innermost layer has a greater Eo than the intermediate layer and wherein the intermediate layer has a greater $E^0$ than the outermost layer.

14. The method of claim 11 wherein a thickness of one or more of the three layers of the solid shell is determined by a time of exposure to the oxidizing environment.

15. The method of claim 10 wherein the shell is formed in a reducing environment.

16. The method of claim 15 wherein the innermost layer has a lower $E^0$ than the intermediate layer and wherein the intermediate layer has a lower $E^0$ than the outermost layer.

17. The method of claim 15 wherein a thickness of one or more of the three layers of the solid shell is determined by a time of exposure to the reducing environment.

18. The method of claim 10 further comprising exposing the solid shell to one or more chelating agents to remove at least a portion of the outermost layer.

19. The method of claim 18 wherein the one or more chelating agents comprises at least one of a carboxylate, an amide, an alkoxide, an amine, a thiol or a phosphate.

20. The method of claim 10 further comprising an etching process that polishes an inner layer of the solid shell.

* * * * *